US011156080B2

(12) United States Patent
Bryant et al.

(10) Patent No.: US 11,156,080 B2
(45) Date of Patent: Oct. 26, 2021

(54) MONITORING SYSTEM WITH AN INSTRUMENTED SURFACE TOP SUB

(71) Applicant: APS Technology, Inc., Wallingford, CT (US)

(72) Inventors: Thomas M. Bryant, Glastonbury, CT (US); William Evans Turner, Durham, CT (US); John Martin Clegg, Glastonbury, CT (US)

(73) Assignee: APS Technology, Inc., Wallingford, CT (US)

( * ) Notice: Subject to any disclaimer, the term of this patent is extended or adjusted under 35 U.S.C. 154(b) by 179 days.

(21) Appl. No.: 15/557,846

(22) PCT Filed: Feb. 28, 2016

(86) PCT No.: PCT/US2016/019996

§ 371 (c)(1),
(2) Date: Sep. 13, 2017

(87) PCT Pub. No.: WO2016/148880

PCT Pub. Date: Sep. 22, 2016

(65) Prior Publication Data

US 2019/0128114 A1 May 2, 2019

Related U.S. Application Data

(60) Provisional application No. 62/133,157, filed on Mar. 13, 2015.

(51) Int. Cl.

| | |
|---|---|
| ***E21B 47/107*** | (2012.01) |
| ***E21B 47/01*** | (2012.01) |
| ***E21B 47/06*** | (2012.01) |
| ***E21B 19/16*** | (2006.01) |
| ***E21B 21/08*** | (2006.01) |
| ***E21B 47/10*** | (2012.01) |
| ***E21B 45/00*** | (2006.01) |

(52) U.S. Cl.

CPC ..... *E21B 47/107* (2020.05); *E21B 19/16* (2013.01); *E21B 21/08* (2013.01); *E21B 45/00* (2013.01); *E21B 47/01* (2013.01); *E21B 47/06* (2013.01); *E21B 47/10* (2013.01)

(58) Field of Classification Search

CPC ..... E21B 19/16; E21B 21/08; E21B 45/00; E21B 47/01; E21B 47/06; E21B 47/10; E21B 47/101

See application file for complete search history.

(56) References Cited

U.S. PATENT DOCUMENTS 5,819,848 A * 10/1998 Rasmuson ..... E21B 47/0007 166/250.15
6,967,589 B1 11/2005 Peters
7,108,081 B2 * 9/2006 Boyadjieff ..... E21B 21/106 175/40

(Continued)

OTHER PUBLICATIONS

International Search Report and Written Opinion of PCT/US2016/019996 dated Aug. 1, 2016. 20 pages.

(Continued)

*Primary Examiner* — Caroline N Butcher
(74) *Attorney, Agent, or Firm* — Offit Kurman, P.A.; Gregory A. Grissett

(57) ABSTRACT

An embodiment a monitoring and control system that includes an instrumented top sub configured to obtain drilling data.

40 Claims, 14 Drawing Sheets

(56) References Cited

U.S. PATENT DOCUMENTS

| | | | | |
|---|---|---|---|---|
| 7,477,161 | B2 | 1/2009 | Macpherson et al. | |
| 7,784,565 | B2 | 8/2010 | Wells et al. | |
| 7,814,988 | B2 | 10/2010 | Peter | |
| 8,210,268 | B2 | 7/2012 | Heidecke et al. | |
| 8,281,856 | B2 | 10/2012 | Jahn et al. | |
| 8,462,013 | B2 | 6/2013 | Hawthorn et al. | |
| 8,544,564 | B2 | 10/2013 | Moore et al. | |
| 2007/0030167 | A1 | 2/2007 | Li et al. | |
| 2008/0202810 | A1 | 8/2008 | Gomez | |
| 2010/0224409 | A1 | 9/2010 | Sarhad et al. | |
| 2011/0016964 | A1 | 1/2011 | Strom | |
| 2011/0083845 | A1* | 4/2011 | McLaughlin | E21B 47/01 166/254.2 |
| 2011/0153225 | A1* | 6/2011 | Mangal | G01F 1/00 702/24 |
| 2011/0186353 | A1* | 8/2011 | Turner | G05B 13/048 175/40 |
| 2012/0031628 | A1* | 2/2012 | Jahn | E21B 19/166 166/380 |
| 2012/0056751 | A1* | 3/2012 | Field | E21B 7/022 340/854.6 |
| 2012/0080227 | A1 | 4/2012 | Cardellini et al. | |
| 2012/0222492 | A1* | 9/2012 | Quin | G01F 1/662 73/861.28 |
| 2013/0186685 | A1 | 7/2013 | Martin | |
| 2014/0102796 | A1 | 4/2014 | Veneruso | |
| 2015/0021016 | A1* | 1/2015 | Deng | E21B 19/166 166/250.01 |
| 2015/0308253 | A1* | 10/2015 | Clark | E21B 33/085 175/24 |

OTHER PUBLICATIONS

International Preliminary Report on Patentability of PCT/US2016/019996 dated Sep. 19, 2017. 13 pages.

* cited by examiner

MONITORING SYSTEM WITH AN INSTRUMENTED SURFACE TOP SUB

CROSS-REFERENCE TO RELATED APPLICATIONS

The present application is the National Stage Application of International Patent Application No. PCT/US2016/019996, filed Feb. 28, 2016, which claims priority to and the benefit of U.S. Provisional Patent Application Ser. No. 62/133,157, filed Mar. 13, 2015, entitled "MONITORING SYSTEM WITH AN INSTRUMENTED TOP SUB," the entire contents each application listed in this paragraph is incorporated by reference in this application.

TECHNICAL FIELD

The present disclosure relates to a monitoring system for a drilling operation, and in particular to a monitoring system that includes an instrumented top sub.

BACKGROUND

Drilling for oil and gas is costly and complex. The time required to reach the target or potential hydrocarbon source has a direct impact on the cost to extract hydrocarbons. To minimize drilling time, oil company operators, drilling rig contractors, and more recently, measurement-while-drilling (MWD) service companies, must understand, monitor, manage, and effectively control the drilling process and drill string behavior downhole. Drilling complexities are significant and include: 1) a wide spectrum of type and size downhole equipment that comprise the bottom hole assembly (e.g. drill bits, drill pipes, drill collars, MWD and logging-while-drilling (LWD) tools, stabilizers, drilling motors, and steering tools); 2) significant operational variances in parameters (e.g. rate-of-penetration (ROP), weight-on-bit (WOB), drill string torque, and rotary speed); 3) large ranges in drilling fluid conditions (e.g. mud weight, formation pressure, bit and annular hydraulics); 4) borehole conditions (e.g. inclination, doglegs, diameter, tortuosity, formation characteristics); and 5) drill rig capabilities (e.g. input horsepower, torque, pump fluid output, condition of equipment such as drill pipe, etc.). These complexities make the quest to understand and control the drilling operation in order to ultimately improve overall drilling efficiency a difficult task.

Effective drilling process control requires reliable data concerning parameters of interest. Historically, basic measurements of interest include depth, drill string torque, drill string rotational speed, drill string tension (i.e. hookload), drill string compression or WOB, drilling fluid flow rate, drilling fluid density, drilling fluid pressure and temperature, and drill string vibration. Service companies were typically contracted to provide the sensors for measuring and monitoring many of these and other parameters. The sensors evolved from being characterized as rather crude to providing a basic adequacy for general behavioral inferences of the parameter of interest. Sensor data was typically logged at frequencies ranging from as low as 1 sample every 10 seconds (0.1 Hz), to a typical 1 sample every second (1 Hz) and more recent to 10 samples per second (10 Hz). Eventually, sensor data was loaded directly to an electronic data recorder (EDR) systems installed on the rigs. In some cases, satellite-link communications were used to transmit drilling data directly to an oil company office.

Many rigs lack reliable surface data at the expense of drilling operational efficiencies. Poor surface data and unreliable sensors increase drilling downtime and costs. Typical surface-based sensors are not suitable for accurate monitoring of the drilling operation. In some cases, surface rig sensors obtain measurements that are, at best, indirect approximations of the desired parameter. In other cases, the measurements of interest are measured offline or rely on human input. Typical surface sensors require frequent repair, maintenance, calibration, and battery replacement, all of which increase drilling downtime and operational costs. Rigs that operate with the disadvantages associated with inadequate surface sensors and unreliable surface data are unable to achieve operational efficiencies increasingly being demanded by operators and well owners.

There are several examples of unreliable or inaccurate surface data using typical surface sensors or measurement techniques. For example, the measurement of drill string torque has been based on rig torque sensors taking measurements of the rotary table motor, power swivel, or top drive input motor current. While motor current may be related to torque, the measured motor current may reflect draws additional to the motor. In another example, hook-load sensors, which are typically clamp-on sensors attached to the drawworks deadline, are used to approximate weight of the drill string and estimate the weight-on-bit (WOB). But hook-load sensor data tends to drift with changes in clamping force, time, temperature, and weather. Another measurement that is subject to error is that of drill pipe or stand length, which can be used to approximate the depth of the drill bit inside the borehole. Pipe length measurements are typically made by several rig personnel using a hand-held tape measure.

Measurements may be rounded to the nearest tenth of a meter or foot, and recorded in a tally book. As the pipe length numbers are transferred from one source to another, there are many further opportunities to introduce errors.

Drilling fluid dynamics is another area where surface data currently collected is different from the actual parameters or the type of sensors are costly and unreliable. Drilling fluid flow rate and density are two of the more important parameters related to drilling fluid dynamics. Yet density is typically only measured several times a day, off-line, and manually. The measured density is then used as an input into an existing control system, or it may be used by the driller to directly intervene in the drilling operation. Density is simply accepted and assumed to be a parameter that varies slowly when in fact it may change fairly rapidly over the course of a drilling run.

Drilling fluid flow rate affects several aspects in a drilling operation, such as operation of mud-pulse telemetry tools, operation of downhole drilling motors, cleaning of the bit teeth, and cuttings removal. But dedicated surface flow meters are costly and require frequent calibration. Typically, such flow meters measure flow rate along the discharge line or standpipe at a location removed from the drill string dynamics. In other words, flow rate in the passage of the drill string is not measured, rather flow rate is measured somewhere between the drill string and the mud pump. In the absence of dedicated surface flow meters, the flow rate is estimated based on characteristics of mud pumps, such as pump pressure, mechanical "cat whisker" stroke counters, and guesses as to pump volumetric efficiencies. As a consequence, the actual flow rate at the drill string may be considerably different than flow rate estimates described above.

SUMMARY

There is a need for a comprehensive suite of high quality drilling data that can be used to efficiently monitor a drilling operation, and adjust and/or control the drilling operation and drill string behavior in an effort to improve drilling efficiency. An embodiment of the present disclosure is a monitoring system including an instrumented sub. The instrumented sub is configured to be coupled to a drill string at or above a rig floor surface of a drilling rig. The instrumented sub includes a body including a top end, a bottom end spaced from the top end in an axial direction, and an internal passage that extends from the top end to the bottom end along the axial direction. The internal passage is configured to receive therethrough a drilling fluid when the body is coupled to the drilling rig. A plurality of sensors are carried by the body, each sensor configured to obtain data indicative of a drilling parameter. The instrumented sub includes a controller electrically connected to the plurality of sensors. The instrumented sub also includes a communication device electrically connected to the controller. The communication device is configured to transmit data obtained by the sensors to a computing device on the drilling rig.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION OF ILLUSTRATIVE EMBODIMENTS

Figure 1:
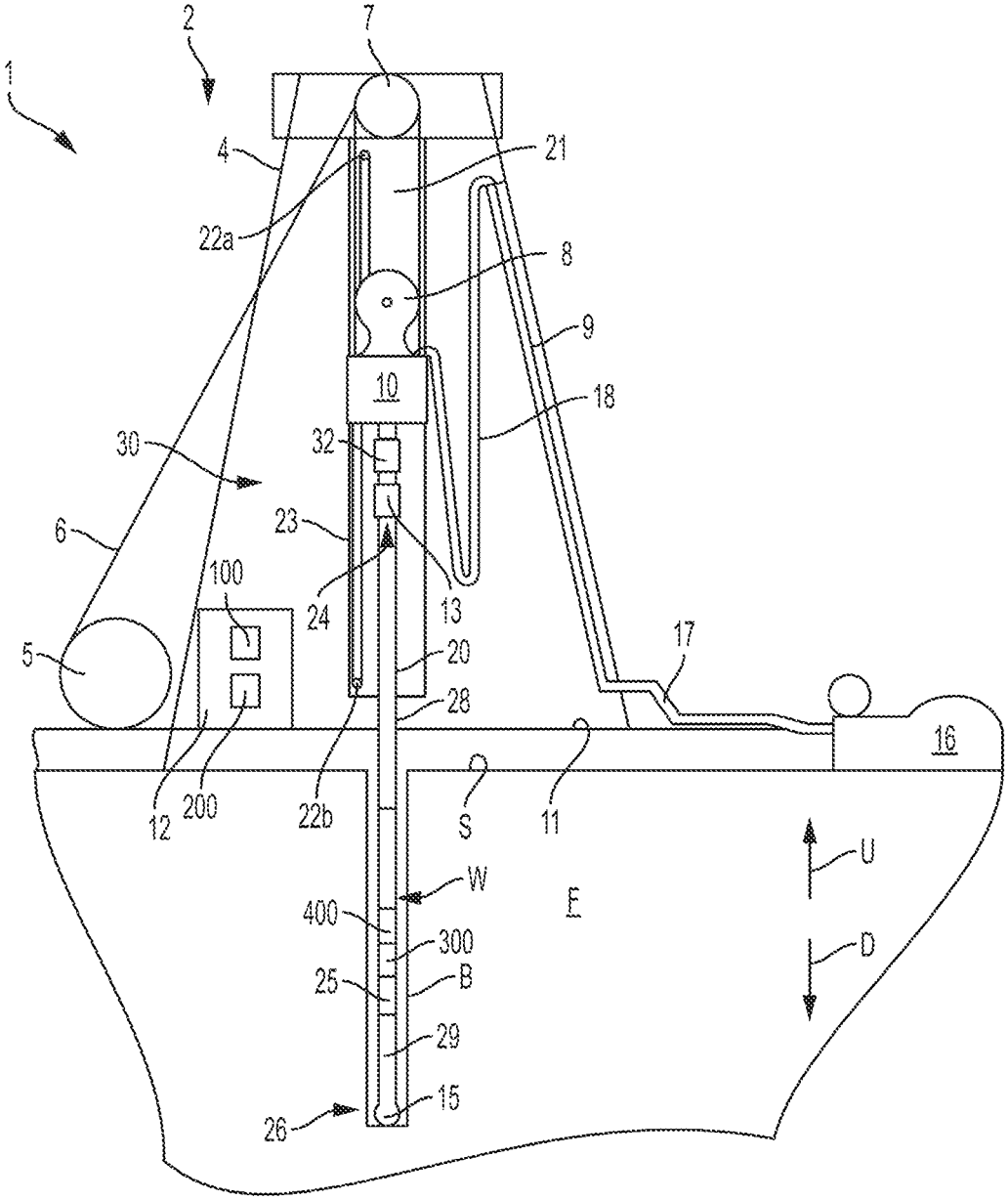
FIG. 1 is a side schematic view of a drilling system including a monitoring system according to an embodiment of the present disclosure.
Figure 4:
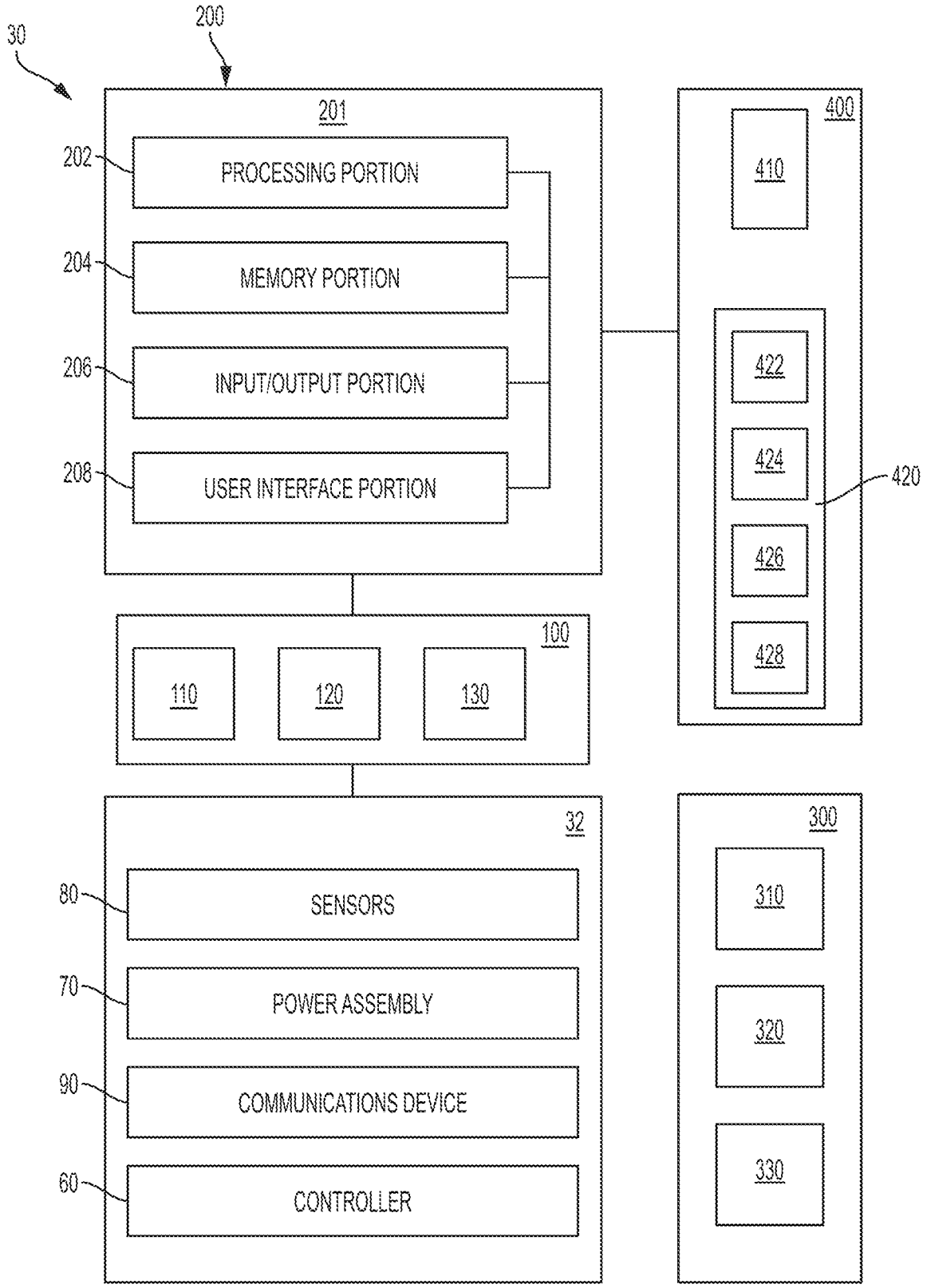
FIG. 4 is a schematic block diagram of a monitoring system for the drilling system illustrated in FIG. 1.

Embodiments of the present disclosure include a monitoring system used to obtain and process data for use in the monitoring and control of one or more phases of a drilling operation of a drilling system. Referring to FIGS. 1 and 4, the monitoring system 30 includes an instrumented top sub 32, a surface communication system 100, and a surface control system 200. The instrumented top sub 32 is configured to obtain surface data concerning various parameters of interest and transmit the obtained surface data to the surface control system 200 via the surface communication system 100. The monitoring system 30 can also include one or more downhole tools 300 that are configured to obtain downhole data during a drilling operation. A downhole communication system 400 can be used to transmit the downhole data to the surface control system 200. The drilling operation can be controlled in response to operator inputs into the surface control system 200. A "drilling operation" as used herein may include, but is not limited to, rig set-up, make-up, tripping in (or out), and/or active drilling runs where drilling into the formation F occurs.

The monitoring system 30 can obtain and process surface data and downhole data for use in the monitoring, control, and operation of the drilling system 1. "Surface data" as used herein means data obtained by sensors that are at or above the surface S of the formation. "Downhole data" as used herein means data obtained by tools that are located downhole in the borehole B during a drilling run. Furthermore, the monitoring system 30 can obtain and process drilling data, and in combination with one or more models (such as a drill string model), monitor drilling parameters or compliance to certain predetermined thresholds. For instance, the monitoring system 30 can also be used to monitor complex dynamics, such as vibration, and alert the operator when measured parameters approach a critical threshold.

Referring to FIG. 1, the drilling system 1 includes a drilling rig 2 that is configured to support and operate a drill string 20 for defining a borehole B into the earthen formation F. A drill bit 15 is coupled to a downhole end 26 of the drill string 20 and is designed to cut into the formation F to define the borehole B. The drilling rig 2 includes a mast 4, a drill floor 11 located at or above the surface S of the formation F, a driller's cabin 12, and draw works 5. The mast 4 supports the drill string 20, as well as various components of the rig 2, such as the crown sheave 7, traveling block 8, and the top drive unit 10. The draw works 5 are connected to the traveling block 8 and crown sheave 7 via the drill line 6. The top drive unit 10 is fixed to the traveling block 8 and is moveably attached to a top drive running rail 21. The instrumented sub 32 is positioned below the top drive unit 10. Two pulleys 22*a*, 22*b* are attached to the running rail 21 and include a depth line 23. One end of depth line 23 is attached to the top drive unit 10. From driller's cabin 12 located on the drill floor 11, the driller can control the upward and downward movement of the drill string 20 by "taking in" or "paying out" drill line 6, which in turn changes the position of the top drive unit 10 relative to the rig floor 11.

Continuing with FIG. 1, the drill string 20 includes an uphole end 24 located at or near the surface S of the formation F and a downhole end 26 that extends into the borehole B of the formation F along a downhole direction D. A downhole (or downstream) direction D refers to the direction from the surface S toward a bottom end (not numbered) of the borehole B and an uphole (upstream) direction U refers the direction from the bottom end of the borehole B toward the surface S. Accordingly, "downhole" or "downhole location" means a location toward the bottom end of the drill string 20 relative to the surface S from a reference location. Accordingly, "uphole" or "uphole location" means a location toward the surface relative to the surface S from a reference location that is downhole.

Continuing with FIG. 1, the drill string 20 includes multiple drill string tubulars 28 connected end-to-end and a bottom hole assembly 29. Each drill string tubular 28 has threaded connectors at each of its opposing ends. The threaded connectors are usually formed in accordance with API standards and may be box or pin type ends. The drill string tubulars 28 can be threadably connected end-to-end during a make-up operation, as will be further detailed below. The bottomhole assembly 29 includes one or more downhole tools 300, a mud motor 25, and the drill bit 15. The downhole tools 300 may be a directional tool (e.g. a rotary steerable tool) and/or a measurement-while-drilling (MWD) tool. The mud motor 25 can be a positive displacement motor that rotates the drill bit 15 in response to mud flowing through the motor 25 toward the drill bit 15, as is known in the art. The tool 300 may include a controller 310, a power source 320, and communications module 330. See FIG. 4. The bottomhole assembly 29 may also include part or all of the downhole communication system 400, also referred to as a telemetry system. The top drive unit 10 applies torque to the drill string 20, causing rotation of the drill string 20 and drill bit 15. The mud motor 25 can rotate the drill bit 15 independent of rotation of the drill string 20. In any event, rotation of the drill bit 15 cuts into the formation F.

During the make-up phase of a drilling operation, a stand of drill sting tubulars 28 can be coupled together and added to the drill string 20 as the drill string 20 is advanced into the formation F by the cutting action of the drill bit 15. For example, the make-up operation may include coupling a first stand to a second stand. In this example, each stand can include one tubular or a multiple tubulars connected-end-to-end before presentation to the drill string. When a new tubular or stand is ready to be added to the drill string 20, the driller can take-in drill line 6, elevating the top drive unit 10, instrumented sub 32, and blow out preventer 13 above the rig floor 11. The drill string tubular 28 is then positioned below and coupled to the blow out preventer 13 or instrumented sub 32. The bottom end of the tubular 28 is coupled to the top end (not numbered) of the existing tubular or drill string 20 positioned partly in the borehole B. Drilling is then initiated and as the drill bit 15 cuts and removes formation F, the driller "pays out" the drill line 6, thereby lowering the traveling block 8, top drive unit 10, and the entire drill string 20 further into the borehole B. The process is repeated as additional drill string tubulars are added to the drill string 20.

Continuing with FIG. 1, during the drilling phase when the drill bit 15 is cutting into the formation F, the driller can control the flow rate of drilling fluid (or "mud") into the drill string 20 and borehole B by activating the mud pump 16 that is plumbed to mud tanks (not shown). Drilling fluid is pushed from the mud pump 16 through the surface flow line 17, up the standpipe 9, through the kelly hose 18, into an internal passage (not numbered) of the top drive unit 10. The drilling fluid continues down the internal passage 37 of the instrumented sub 32 and the internal passage of the drill string 20 to the drill bit 15. The drilling fluid exits the drill bit 15 and returns the surface S through the annular passage of the borehole B defined between the drill string 20 and borehole wall W. The driller can control the rate of flow by altering the pump piston stroke rate of the mud pump 16.

Components of the monitoring system 30 are described next. As can be seen in FIG. 1, the instrumented sub 32 is situated between the top drive unit 10 and an uphole end 24 of the drill string 20. In the illustrated embodiment, the instrumented sub 32 is coupled to a rotatable shaft (not numbered) of the top drive unit 10 and above a lower internal blowout preventer 13. It should be appreciated, however, that the instrumented sub 32 can be threadably connected to a) a top of a drill string tubular 28, b) a top of the blowout preventer 13, or c) a saver sub (not shown).

As shown in FIGS. 2A-2F and 4, the instrumented sub 32 includes a controller 60, a power assembly 70, a plurality of sensors 80, and a communication device 90. The sensors 80 are configured to measure surface data regarding various parameters as will be explained further below. The sensors 80 are also calibrated and configured to collect high-frequency measurements, resulting in reliable and robust data sets. The communication device 90 can transmit obtained surface data to the surface control system 200 for further processing, recording, and display. The power assembly 70 provides power to sensors 80, controller 60, and the communication device 90.

The instrumented sub 32 can measure system surface data for a range of parameters for use by rig personnel in a variety of contexts during a drilling operation. For instance, surface data can be used to optimize the drilling operation, for example, by controlling torque during make-up, weight-on-bit (WOB), or monitoring rate-of-penetration (ROP). Analysis of measured surface data and its correlation to downhole data can be help preserve downhole tools 300 by predicting, warning, and where necessary, causing a control operation to intervene in the drilling operation in order to mitigate damage. For example, surface data can be used to help identify damaging downhole vibrations and initiate corrective actions or possibly prevent damaging vibrations from occurring. Furthermore, the surface data acquired by the instrumented top sub 32 can be combined with similar data acquired from downhole tools, e.g. such as tools that monitor drilling dynamics and vibration monitoring tools, to aid in controlling the drilling system 1. Additional examples of surface and downhole data obtained and monitored by the monitoring system 30 will be described further below.

Figure 2A:
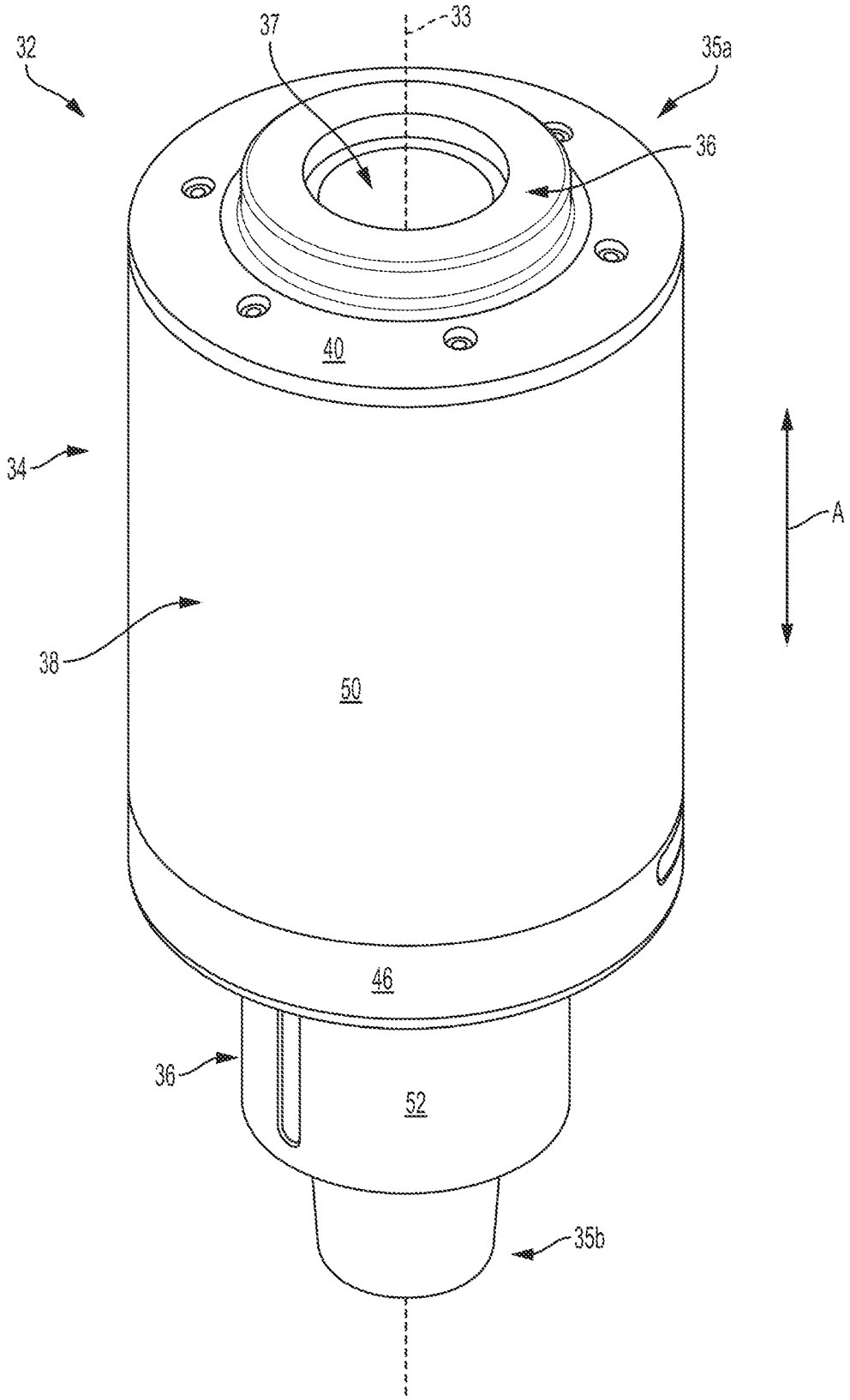
FIG. 2A is a top perspective view of an instrumented sub of the monitoring system shown in FIG. 1.

FIG. 2A illustrates an embodiment of the instrumented sub 32. The instrumented sub 32 includes a body 34 having a top end 35*a* and a bottom end 35*b* spaced from the top end 35*a* along central axis 33. The central axis 33 is aligned with an axial direction A. The body 34 includes a base component 36 (or base pipe), an outer component 38 that surrounds the base component 36, and a sealed, in internal chamber 41 (FIG. 2D) defined between the base component 36 and the outer component 38.

Figure 2B:
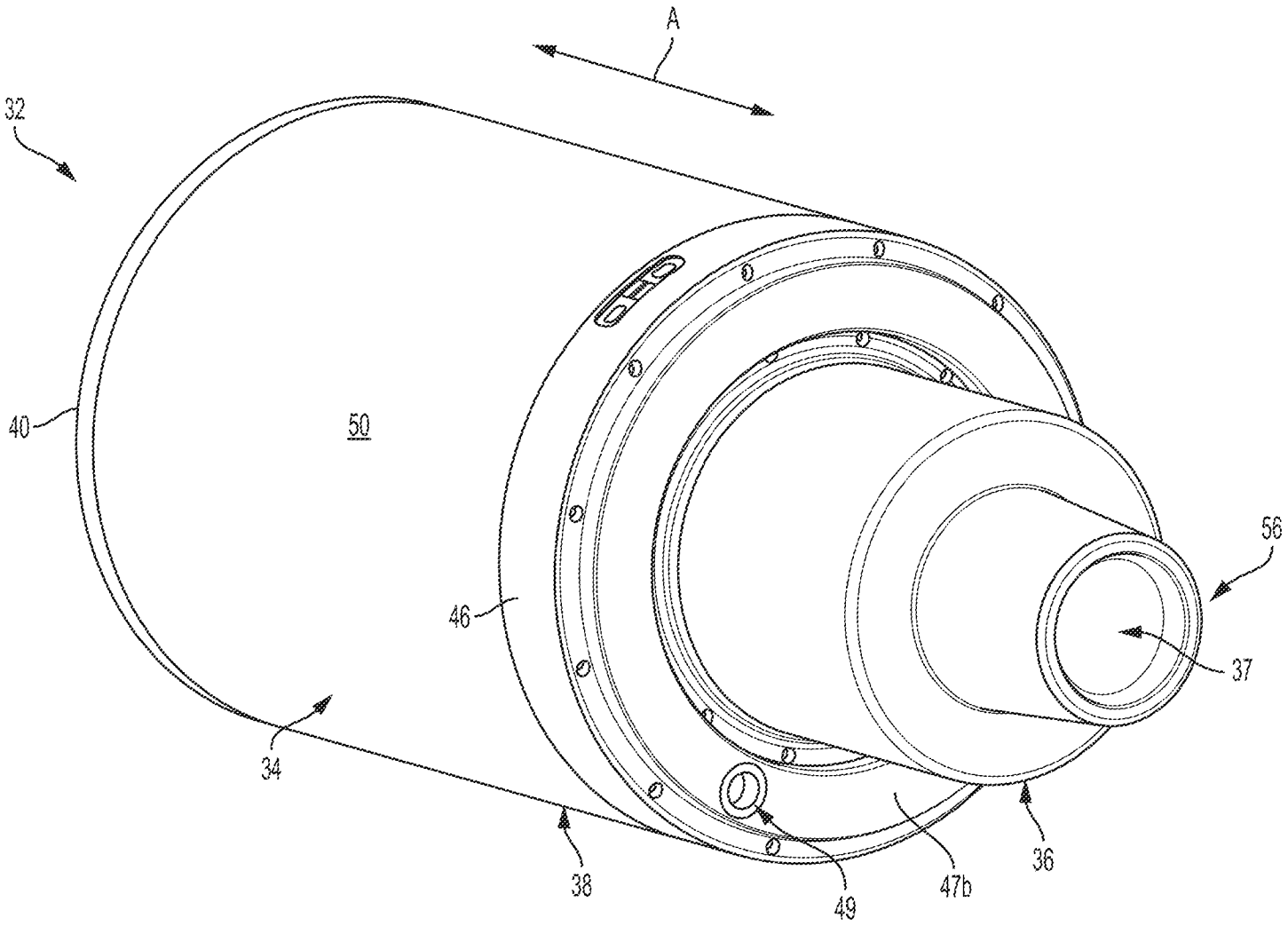
FIG. 2B is a bottom perspective view of the instrumented sub shown in FIG. 2A.
Figure 2C:
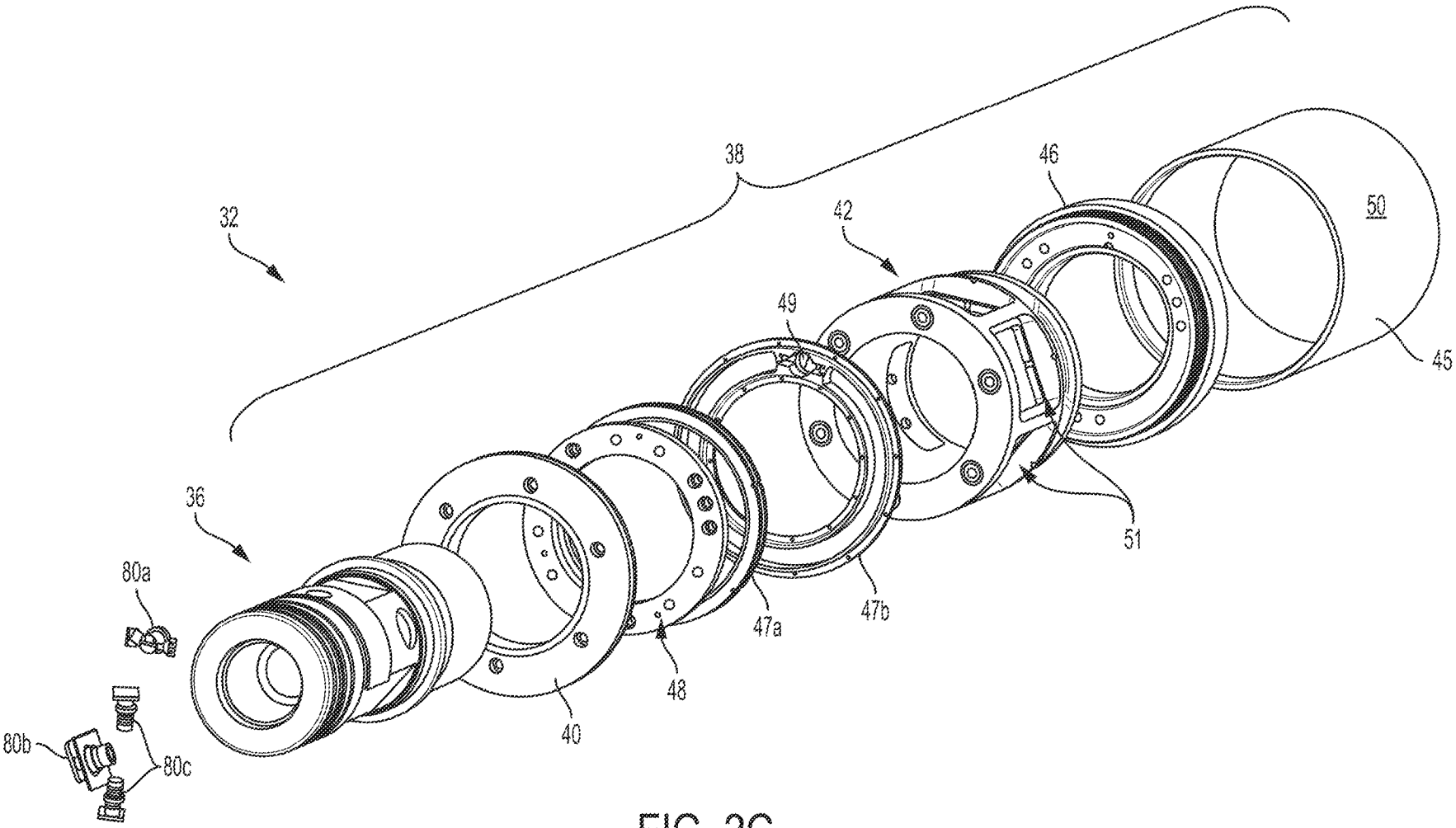
FIG. 2C is an exploded view of the instrumented sub illustrated in FIG. 2A.
Figure 2D:
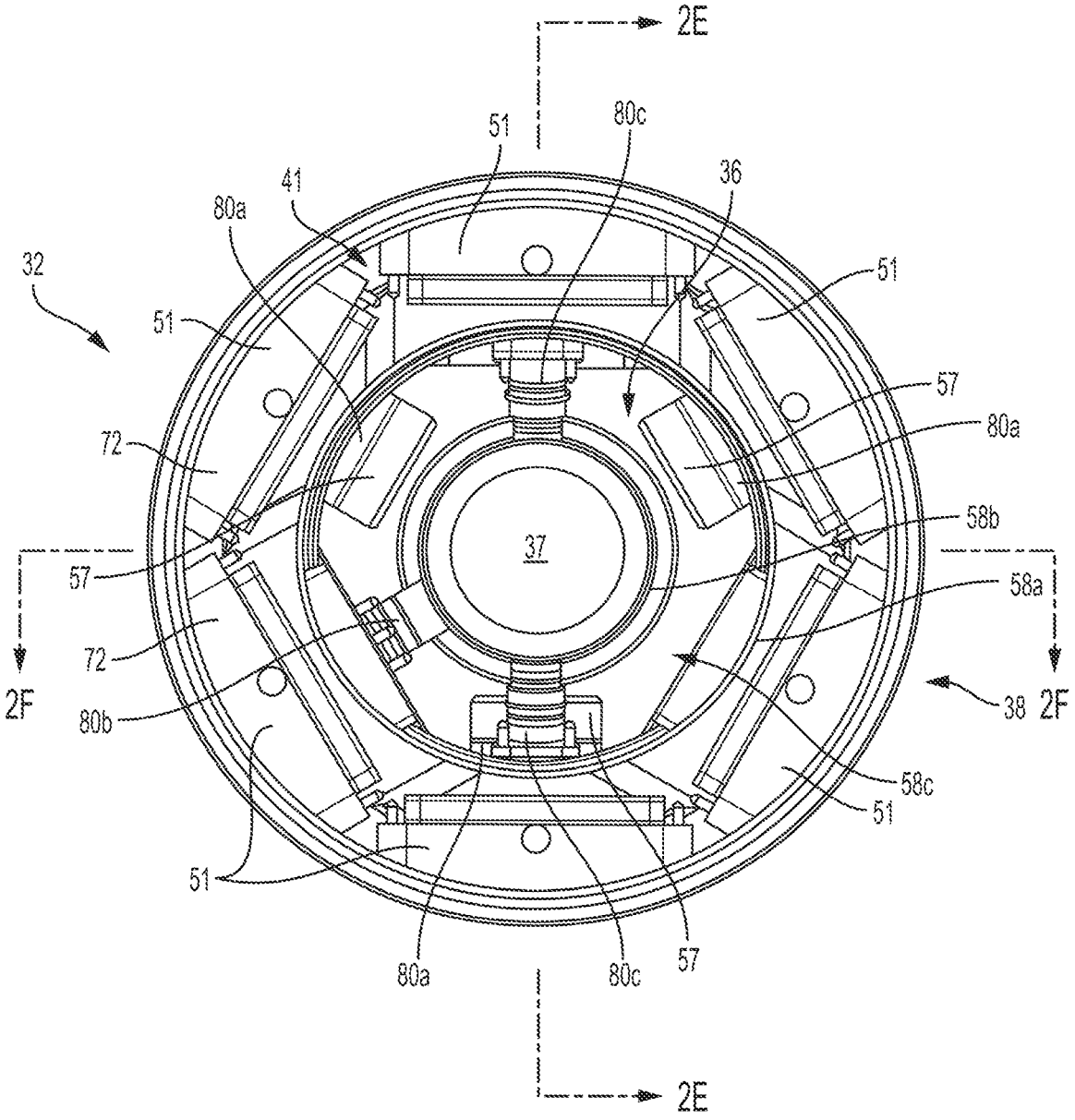
FIG. 2D is a top view of the instrumented sub illustrated in FIG. 2A, with a top plate removed to illustrate internal components of the instrumented sub.
Figure 2E:
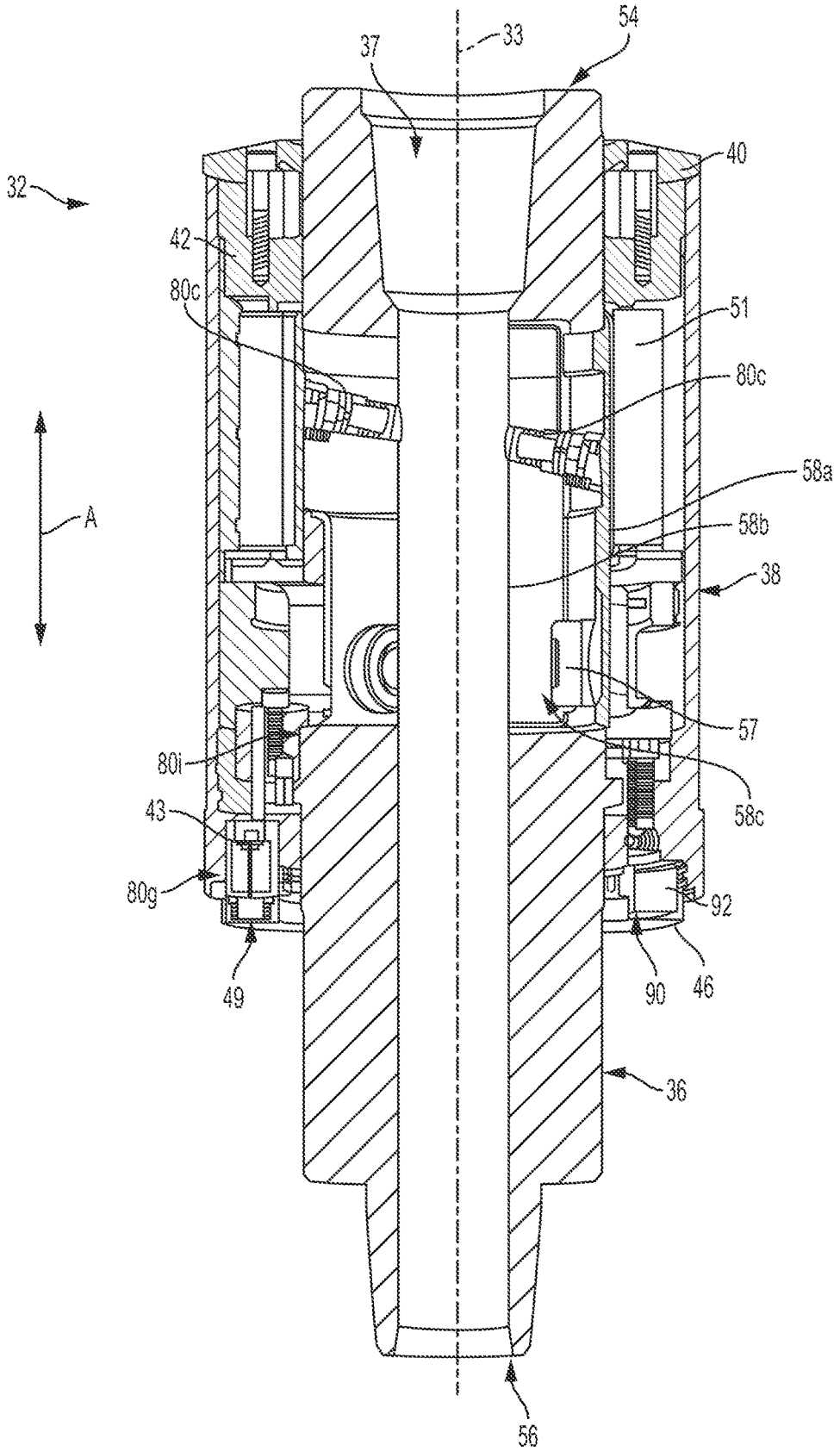
FIG. 2E is a cross-sectional side view of the instrumented sub taken along line 2E-2E in FIG. 2D.
Figure 2F:
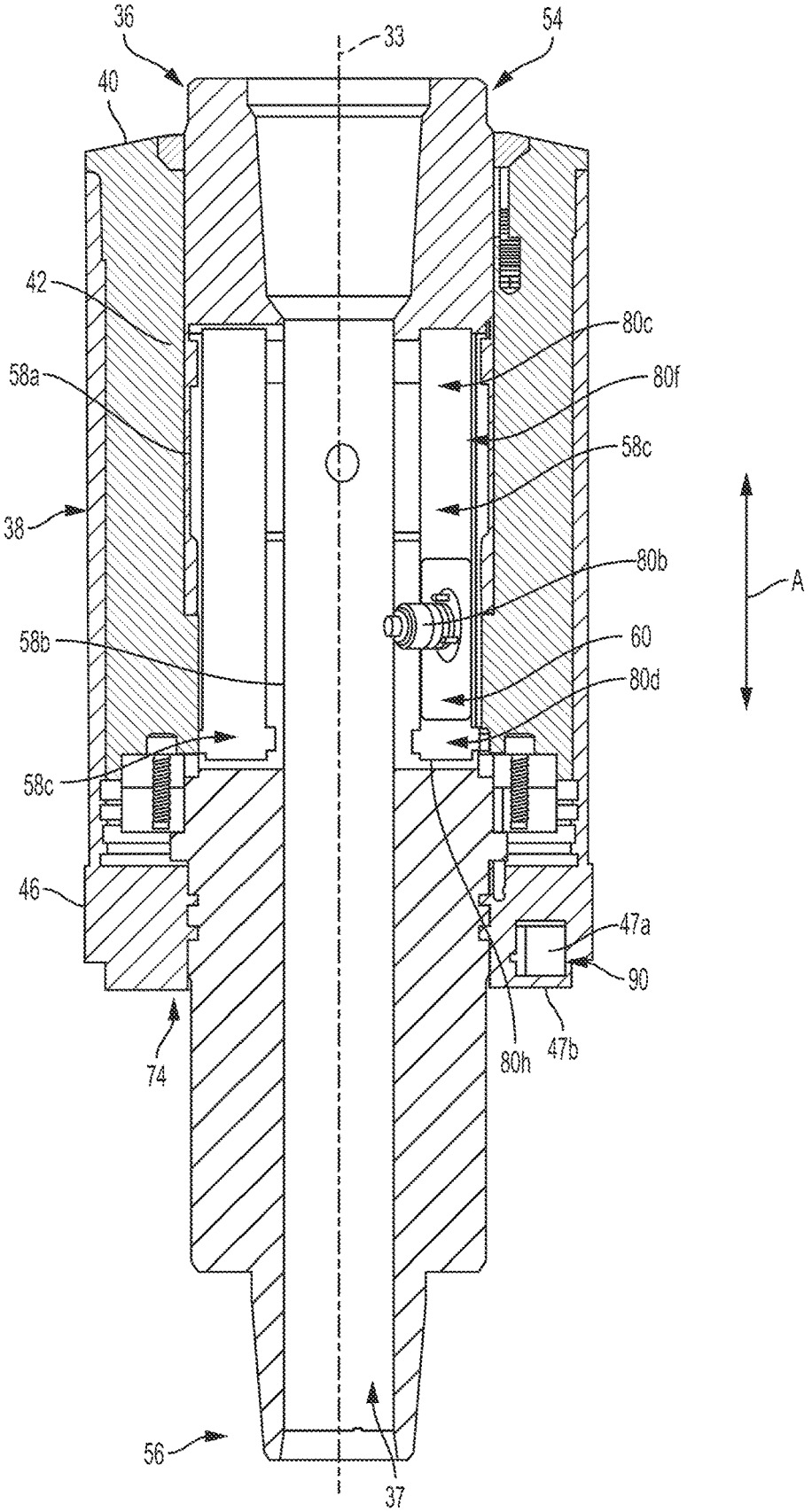
FIG. 2F is a cross-sectional side view of the instrumented sub taken along line 2F-2F in FIG. 2D.
Figure 3A:
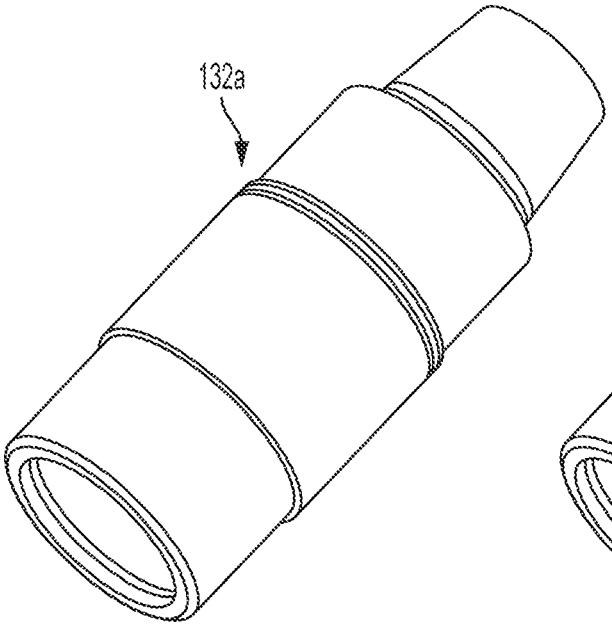
FIGS. 3A through 3G illustrate alternative embodiments of an instrumented sub.
Figure 3B:
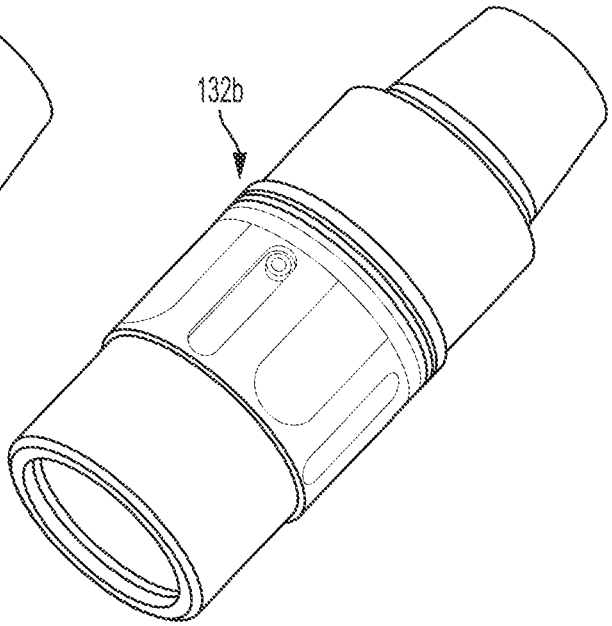
Figure 3C:
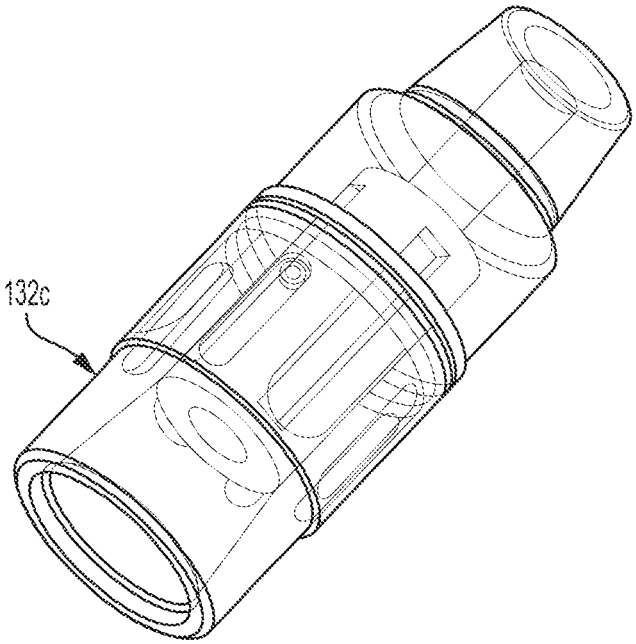
Figure 3D:
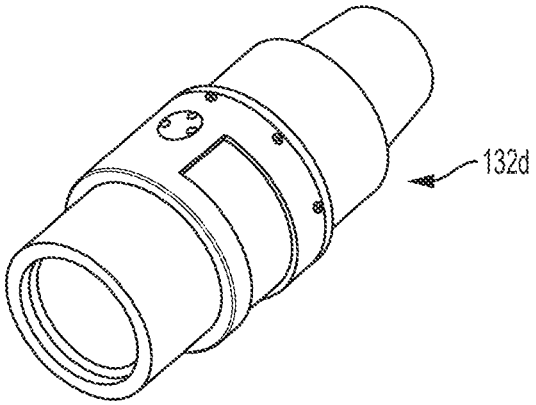
Figure 3E:
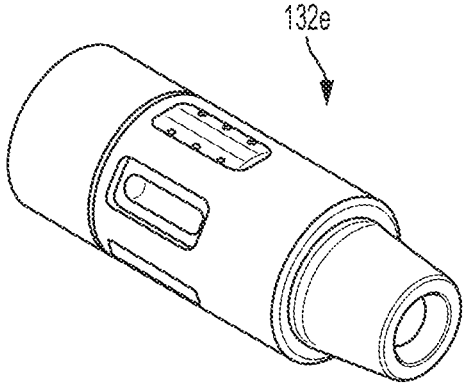
Figure 3F:
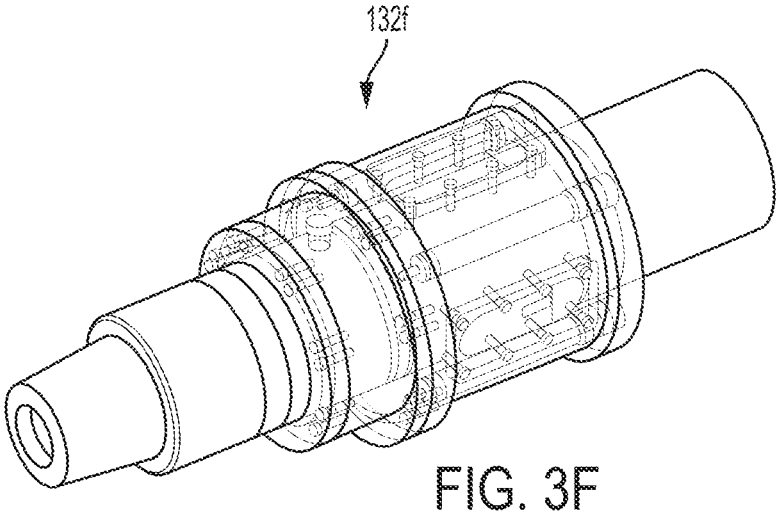
Figure 3G:
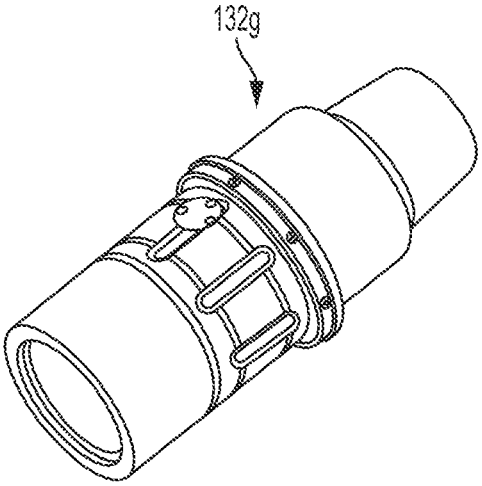

Referring to FIGS. 2D-2F, the base component 36 is a tubular body 52 that is elongate along the central axis 33. The tubular body 52 also defines an internal passage 37 that extends through the body 52 and is configured to receive drilling fluid therethrough. The base component 36 has an upper end 54 and a lower end 56 opposite the upper end 54 along the central axis 33. The upper end 54 can include a threaded connector for coupling to a bottom end, or rotatable shaft, of the top drive unit 10. The lower end 56 can include a threaded connector for coupling to a top end of a drill string tubular 28, a blowout preventer 13, or a saver sub. The connectors defined by the upper end 54 and lower end 56 can be made according to API standards. The body 52 of the base component 36 defines an outer wall 58*a*, an inner wall 58*b*, and a sealed chamber 58*c* that extends between the outer wall 58*a* and inner wall 58*b*. The body 52, and in particular, the outer wall 58*a*, defines a plurality of pockets 57 recessed into the chamber 58*c* toward the inner wall. The pockets 57 are sized to contain the strain gage assemblies discussed below. The inner wall 58*b* extends from the upper end 54 to the lower end 56 and defines the internal passage 37. The base component 36 can support several sensors. For example, the base component 36 can support the flow meters 80*c* and a pressure sensor assembly 80*b*.

Referring to FIGS. 2A-2C, the outer component 38 is a tubular elongate structure with an internal passage 39 that is sized to receive the base component 36. The outer component 38 includes a top plate 40, a housing frame 42, a clamp 44, a bottom plate 46 coupled to clamp 44 and housing frame 42, a retainer assembly 48 coupled to the bottom plate 46, and a cover 50 that surrounds the housing frame 42. The retainer assembly 48 is disposed opposite the top plate 40 along the central axis 33. The housing frame 42 can further define a plurality of circumferentially spaced pockets 51 disposed along an outer surface of the outer component 38. Hatch covers (not shown) can be placed over the pockets 51 to enclose and seal the pockets 51. Battery packs can be carried in the pockets 51. The cover 50 encases the housing frame 42 and defines an external surface 45 of the instrumented top sub 32. As shown in FIG. 2D, the retainer assembly 48 includes a component of the communication device 90, such as a ring shaped antenna 47*a* and a lower plate 47*b* that is secured to the bottom plate 46. The bottom plate 46 further defines an internal cavity (not shown) that supports the communication device 90 that holds one of the sensors 80, such as the distance sensor 80*g*. The lower plate 47*b* includes a port 49 that is aligned with chamber 43 that holds a sensor 80*g* located therein.

Alternative instrumented top subs 132*a*-132*g* are shown in FIGS. 3A through 3G. Each top sub 132*a*-132*g* may include similar components, such as a controller 60, a power assembly 70, sensors 80, and a communications device 90. The top subs 132*a*-132*g* have a different base component and outer component designs.

In one embodiment of the present disclosure, the instrumented sub 32 carries one or more controllers 60, the power assembly 70, the plurality sensors 80, and the communication device 90. Each component will be described next.

Referring to FIGS. 2D-2F, the one or more controllers 60 can control operation of the instrumented sub 32. As illustrated, the controllers 60 are located on circuit boards along with other circuitry. The controllers 60 and circuit boards are located in the sealed chamber 58*c* and are supported by the base component 36. Each controller 60 can include a processor, a memory, and a software program used to process and analyze data as needed, and communication components to facilitate electronic communication with the sensors 80, the power assembly 70, a communication device 90, and a surface control system 200.

As discussed above, the instrumented top sub 32 includes a power assembly 70 that supplies electrical power to the controller 60, sensors 80, and the communication device 90. In accordance with the illustrated embodiment, the power assembly 70 includes a first power source, such as a battery pack, and is configured to supply the power. The power assembly 70 also includes a second power source configured to recharge the first power source. The first power source is a battery pack and the second power source is at least one thermal electric power device. Use of the thermal electric power device considerably reduces the risk of the instrumented sub losing power during operation and significantly alleviates replacement and disposal of batteries. In an alternative embodiment, the first power source is a battery pack and the second power source is an AC supply or mains.

The thermal electric power device is configured to generate power in response to a temperature differential between the drilling fluid passing through the internal passage of the body and air external to the body. The thermal electric power device is a thermal electric generator or a thermal electric cooler. The power assembly comprises a cooling assembly in flow communication with the at least one thermoelectric device. In one example, the second power source is configured to supply at least 70 mW of power to recharge the first power source. In another example, the second power source is configured to supply between about 70 mW and about 100 mW of power to recharge the first power source. The power assembly can include between two sets of thermal electric power devices and eight sets of thermal electric power devices. In one example, the power assembly includes two sets of thermal electric power devices. In another example, the power assembly includes four sets of thermal electric power devices. In another example, the power assembly includes six sets of thermal electric power devices. In another example, the power assembly includes eights sets of thermal electric power devices.

In one example, the controller 60 is configured to determine power assembly information. The power assembly information includes a voltage of the first power source, current, recharging rate, and remaining and charge in the first power source. The communication device can transmit the power assembly information to the surface computing device.

The sensors 80 carried by the instrumented sub 32 can include one or more of the following sensors: a strain sensor assembly 80*a*, a pressure sensor assembly 80*b*, one or more flow meters 80*c*, a gyrometer 80*d*, accelerometers 80*e*, a magnetometer 80*f*, a distance sensor 80*g*, a pressure sensor 80*h*, and a temperature sensor 80*i*. In one embodiment, the sensors 80*a*-80*i* can simultaneously measure values for respective drilling parameters, using the same time clock. The sensors 80, controller 60, and/or surface control system 200 can determine block height, top drive unit height, drill string rotational speed, hook-load/WOB, torque, tension, compression, bending moment, bending angle, drilling fluid pressure, drilling fluid temperature, drilling fluid density, drilling fluid pressure flowrate, and drill string vibrations. These obtained drilling parameters can be used to monitor a drilling operation, for automation and drilling optimization, and to identify, mitigate, and/or prevent drill string dysfunctions, such as twist-offs, pipe buckling, washouts, bit bounce, stick slip, etc. The sensors 80 are calibrated and remain well maintained within a sealed, moisture-free environment within the instrumented top sub 32. The word "sealed" means adequate sealing giving normal tolerances and may not be perfectly sealed. The sensor configuration and controller 60 provide accurate, high frequency measurements. Each sensor 80 will be described next.

The instrumented top sub 32 includes one or more strain sensor assemblies 80*a* configured to measure axial forces (tension and compression), torsional forces, and bending parameters (bending moment and bending angle) along the instrumented sub 32. Each strain sensor assembly 80*a* includes a set of strain gauges that are attached to walls of the pocket 57 of the base component 36 (FIG. 2C). One set of strain gauges may include a plurality of strain gauges, e.g. four separate strain gauges, arranged on a Wheatstone bridge that is electrically coupled to the controller 60 and power assembly 70. In alternative embodiments, the strain gauges in different strain sensor assemblies can be arranged across a multiple Wheatstone bridges. For instance, the instrumented sub 32 may include a first strain sensor assembly, a second strain sensor assembly, a first Wheastone Bridge, and a second Wheatstone Bridge. Each bridge will include strain gauges from both the first strain sensor assembly and the second strain sensor assembly. The respective strain gauges can take a variety forms. In one example, the strain gauge is a thin film strain gauge sensor or "thin film sensor." A thin film sensor can include an insulation layer, an alloy layer applied to the insulation layer, and a protective layer applied to the alloy layer. The strain gauge pattern can be formed in the alloy layer and coupled to electrical leads. In another example, the strain gauge sensor can be a bonded foil strain gauge. It should be appreciated that any strain gauge implementation can be used.

The strain sensor assemblies can measure axial forces, torsional forces, and bending parameters. Specifically, the strain gauges in each strain sensor assembly 80*a* can be oriented to align with the axial direction, a transverse direction that is perpendicular the axial direction, and an angular direction that is angularly offset with respect to the axial direction. Strain gauges aligned with the axial direction and transverse directions are used to determine axial forces (such as tension and compression). The measured axial forces, along with forces measured along the angular direction can be used to determine torsional forces. In accordance with the illustrated embodiment, the strain sensor assemblies 80*a* includes a first bridge of strain gauges, a second bridge of strain gauges, and a third bridge of strain gauges, each of which are disposed in respective pockets 57 positioned at 120 degree intervals around the central axis 33 of the instrumented sub 32. This arrangement permits measurement of bending parameters, such as bending moment, bending load, and bending angle, by obtaining strain readings with the three different strain sensor assemblies located in each pocket 57. The surface control system 200, in particular, the processor, can analyze bending moment, bending load, bending angles for use in a monitoring protocol to assess potential fatigue or other damage to the top drive unit, the top drive quill, and/or pipe connections in proximity to the top of a drill string 20 or connected to the instrumented sub 32. In instances, where axial forces are of interest and bending parameters are not, the strain sensor assemblies 80*a* may include a first bridge of strain gauges and a second bridge of strain gauges disposed 180 degrees opposite the first bridge of strain gauges with respect to the central axis 33.

The strain sensor assemblies as used herein can be constructed in accordance with the U.S. Patent App. Pub. No. 2015/02195080, the disclosure of which in incorporated by reference into this application. The strain gauges can determine axial and torsional forces as described in U.S. Pat. No. 6,547,016 (the "016 patent"), assigned to APS Technology Inc. ("APS Technology"). Bending forces can be obtained in accordance with U.S. Pat. No. 8,397,562 (the "562 patent"), also assigned to APS Technology. The contents of the 016 patent and the 562 patent are both hereby incorporated by reference into this application.

The strain sensor assembly 80*a* is configured to obtain data indicative of axial forces applied to the instrumented sub 32, which can be used to determine WOB. The axial force data may include a measure of hookload. Hookload, in turn, can be used to determine an approximate WOB. In accordance with an embodiment the present disclosure, the driller can elevate the top drive unit 10 and pick up the drill string 20 and drill bit 15 off the bottom of the borehole B. The instrumented sub 32 can measure the weight of the drill string 20 suspended from the mast by measuring tension along the instrumented sub 32 with the strain sensor assembly. The initial data is also referred to as initial or first hookload measurement. The driller can then lower the drill string 20 and drill bit 15 back to the bottom of the borehole B. Application of weight at the bit 15 to promote cutting and forward advancement in the formation decreases the actual hookload. The strain sensor assembly 80*a* measures tension along the instrumented sub 32 again, which is related to hookload. The second measurement of tension may be referred to as the final or second hookload measurement. The control system, in particular, the processor, can determine WOB based on the difference between the first hookload measurement and the second hookload measurement. The obtained WOB is a fairly direct measurement made at the instrumented sub 32.

In an alternative embodiment of the present disclosure, the strain sensor assemblies 80*a* are configured to obtain vibration data. Vibration data may include one or more of a mode shape, an amplitude and frequency. Furthermore, the vibration data may include a) axial vibration of the instrumented sub, b) torsional vibration of the instrumented sub, c) lateral vibration of the instrumented sub, d) radial vibration of the instrumented sub, and/or e) tangential vibration of the instrumented sub. Specifically, strain gauges can be arranged in any manner to determine vibration data as described above.

As described above, the strain sensor assembly 80*a* can make a direct measurement of forces such as tension, compression, torsion, bending moment, bending load, and bending angle along the instrumented sub 32. Such forces are can be used to determine hook-load, WOB, and drill string torque, and possibly drag forces when combined with a drill string model. In other examples, bending parameters can be used to determine tool fatigue. In other examples, the strain sensor assembly 80*a* can be used to determine vibration data. The strain sensor assembly measurements may be corrected for changes in temperature and pressure, and when calibrated against known standard forces, may provide accuracies at 1 to 2%. Data accuracy at 1 to 2% is believed to far exceed the data accuracy of most, if not all rig surface sensors typically used to measure hook-load, WOB, and drill string torque.

As best shown in FIGS. 2D and 2E, the instrumented top sub 32 may include a pressure sensor assembly 80*b* and flow meters 80*c* that are configured to obtain data indicative of drilling fluid dynamics. Fluid parameters of interest include fluid pressure, temperature, flowrate, and density, which are fundamental metrics related to circulating fluid hydraulics and drilling fluid rheology in the drilling fluid system. Drilling fluid parameters are important for a range of functions in a drilling operation, such as circulating fluid hydraulics, hole cleaning, gas detection, well logging, well control, operation of downhole mud motors, mud pulsers, and the like. The pressure sensor assembly 80*b* and flow meters 80*c* as described herein provide reliable, accurate, and frequent measures of pressure, temperature, flowrate, and density, which facilitate real time drilling optimization. Adding even greater value to the driller is that these measurements are made at the top of the drill string, representing actual data for inputs to the drilling system. Coupled with additional sensors to measure fluid exiting the drill bit or borehole fluid conditions in the drilling string can accurately monitored.

Continuing with FIGS. 2D-2F, the pressure assembly sensor 80*b* is sealed within the internal chamber 58*c* of the base component 36. The pressure assembly sensor 80*b* has open access to the internal passage 37 via a port. The pressure sensor assembly 80*b* includes a pressure transducer and a temperature sensor. The pressure assembly sensor 80*b* is configured to measure a pressure of the fluid as it passes through the internal passage of the body 34.

Continuing with FIGS. 2D and 2E, the plurality of flow meters 80*c* are designed to measure drilling fluid flowrate and density. The flow meters 80*c* are also housed within internal chamber 58*c* of the base component 36 and positioned to face the internal passage 37. The flow meter 80*c* can obtain data that is indicative of a flow rate of the fluid through the internal passage 37. In one example, the flow meter includes sensor housing, a transducer, and a wiring for electrical connection to the controller 60 and power assembly 70. The flow meter 80*c* may also include a high pressure electrical connector and a backup high pressure containment fixture, which is used to avoid broaching drilling fluid from the internal passage 37. The flow meter 80*c* measures the velocity of a fluid with ultrasound via the transducer. The transducer can include a piezoelectric crystal. The average velocity is determined along the path of an emitted beam of ultrasound. In one example, the average velocity is average of the difference in measured transit time between the pulses of ultrasound propagating into and against the direction of the flow. In alternative embodiment, however, the flow meter can be a differential pressure flow meter.

In one example, the processor can determine fluid gain or loss based on a measured flow rate at the instrumented sub 32 and a measured flow rate of the fluid exiting at least one of a drill bit and the borehole.

In another example, the pressure sensor assembly can be used to monitor the drilling fluid dynamics. The processor is configured determine if the measured pressure is outside of a predetermined range. If the measured pressure is outside of the predetermined range, the processor can cause a message to be displayed via a user interface 208 of the surface control system 200, indicating that a detrimental drilling event is possible. The detrimental drilling event may include one or more of the following: a washout; a loss of pump motor power; a decrease in mud motor efficiency; a decrease in mud motor torque; a mechanical failure of a drill string tubular; and/or a mechanical failure of connections between the instrumented sub and a top drive unit. The processor is further configured to determine which one of the detrimental drilling events is likely to occur based on the measured pressure of fluid in instrumented sub 32, a measured pressure of the fluid in the borehole B, a measured pressure of the fluid between the pump and the instrumented sub 32, and a measured flow rate of the fluid.

The instrumented top sub 32 includes a sensor configured as a gyrometer 80*d*. The gyrometer 80*d* is carried by the base component 36. As shown in FIG. 2F, the gyrometer 80*d* is disposed within the sealed chamber 58*c* proximate a control board (not numbered) and pressure sensor assembly 80*b*. The gyrometer 80*d* is configured to obtain data that is indicative of a rotational speed of the instrumented sub 32 when the instrumented sub is coupled to a top drive unit and caused to rotate. The gyrometer 80*d* measures tangential acceleration of the instrumented sub 32. The controller and/or processor for the surface control system 200 can determine rotational speed (RPM) based on the obtained tangential acceleration data. While many top drive units are equipped with magnetic proximity sensors and cables for measuring drill string rotational speed, these typical sensors are subjected to an environment of water, oil, grease and dirt, are often not well maintained, are difficult and costly to install and replace, and may often fail. The present disclosure includes sensors contained in a sealed environment and generally designed and adapted for robust performance in the drilling environment. While a gyrometer can be used, a gyroscope can be used to determine rotation speeds, turns, etc.

The gyrometer 80*d* can be used to determine turns of the instrumented top sub 32. The processor (of controller 60 or surface control system 200) can determine the number of turns of the instrumented top sub 32 based on the integration of measured rotational speed over the duration that the measurements are obtained. The number of turns can be used to help monitor and control the make-up operation, as will be further described below.

The instrumented top sub 32 include sensors configured as a set of accelerometers 80*e* and magnetometers 80*f* that can be used to obtain vibration data. Vibration data may include one or more of a mode shape, an amplitude and frequency. Furthermore, the vibration data may include a) axial vibration of the instrumented sub, b) torsional vibration of the instrumented sub, c) lateral vibration of the instrumented sub, d) radial vibration of the instrumented sub, and/or e) tangential vibration of the instrumented sub. Specifically, accelerometers and magnetometers can be used to determine vibration data. In one example, vibration data, such as amplitude, mode shape and frequency can be obtained according to the Vibration Memory Module™ as described in U.S. Pat. No. 8,453,764 (the "764 patent"), assigned to APS Technology. The disclosure in the 764 patent related the Vibration Memory Module™ is hereby incorporated by reference into this application. For example, the Vibration Memory Module™ utilizes accelerometers and magnetometers to determine the amplitudes of axial vibration, and of lateral vibration due to forward and backward whirl, at the location of these sensors. The Vibration Memory Module™ also determines torsional vibration due to stick-slip by measuring and recording the maximum and minimum instantaneous rotational speed (RPM) over a given period of time, based on the output of the magnetometers. The amplitude of torsional vibration due to stick-slip is then determined by determining the difference between and maximum and minimum instantaneous rotary speeds of the drill string over the given period of time. The frequency of the vibration can be determined based on obtain vibration data. The data can be used to identify dysfunctions, such as stick-slip, bit whirl, bit bounce, etc.

The magnetometer 80*f* can also be used to obtain data indicative of rotational speed of the instrumented sub 32 and thus the drill string. The magnetometer 80*f* can also obtain data that can be useful for detecting drill string dysfunctions such a stick-slip, bit whirl, bit bounce, etc.

Figure 5:
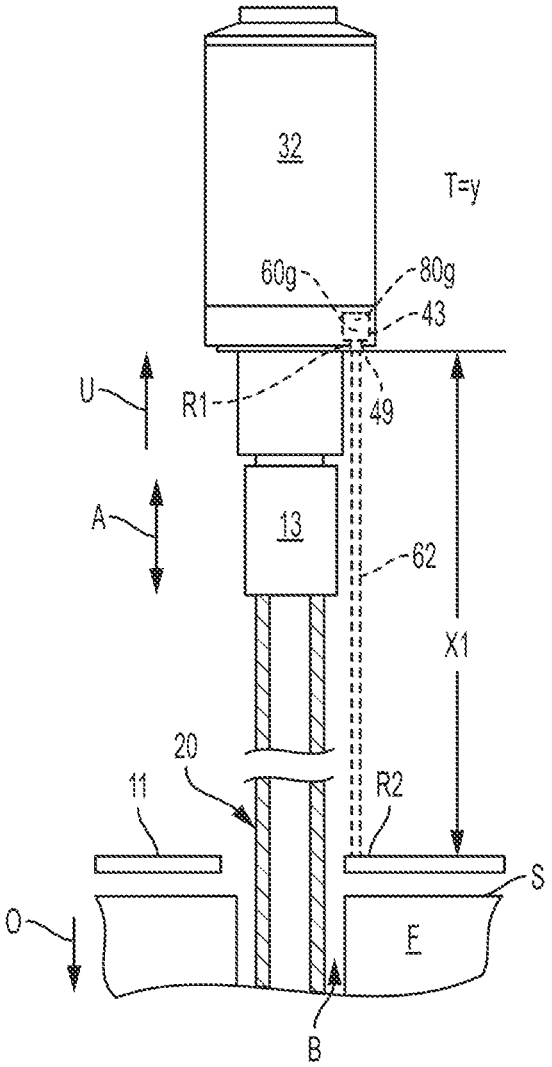
FIGS. 5 and 6 are schematic side views of the instrumented sub coupled to the drill string with the instrumented sub at first and second positions above a rig floor, respectively.
Figure 6:
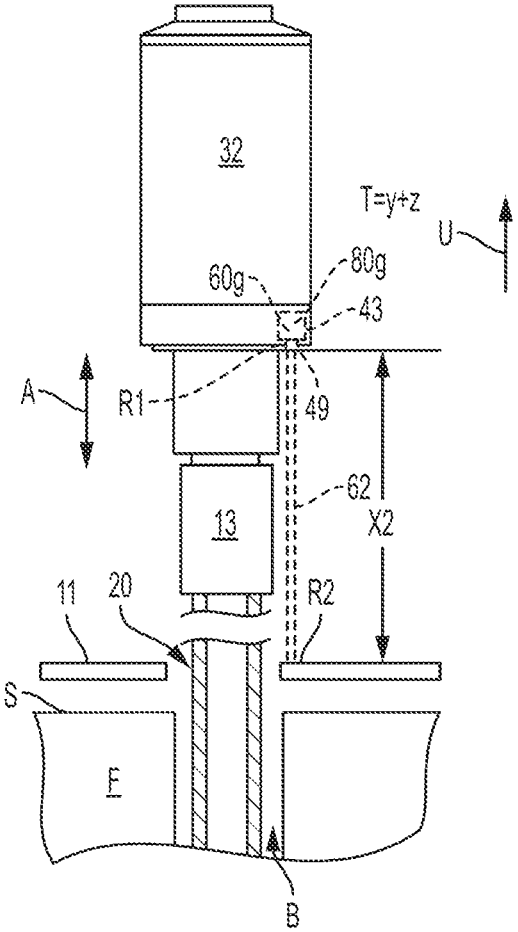

Turning to FIGS. 2F, 5 and 6, the instrumented top sub 32 includes a distance sensor 80*g* configured to determine a distance X from a first reference location R1 on the body 34 to a second reference location R2 that is spaced away from and aligned with the first reference location R1 along the axial direction A. As illustrated, the distance sensor 80*g* is a laser rangefinder that resides in chamber 43 of the body 34. The laser rangefinder has a line of sight through the port 49 of the lower plate 47*b* to the second reference location R2. The first reference location R1 is the surface of the plate 47*b* adjacent to the port 49. The first reference location R1 can be a face of the laser rangefinder as well. The second reference location R2 is the surface of the rig floor 11 below the instrumented top sub 32. The laser rangefinder includes a transmitter that transmits an energy pulse 62 through the port 49 to the second reference location R2. The energy pulse 62 is reflected back through the port 49 to a receiver that is adjacent to the transmitter in the laser rangefinder. The laser rangefinder measures the roundtrip time of the energy pulse 62 from the transmitter to the second reference location and back to the receiver. The laser rangefinder includes a processer that determines distance X by dividing half (½)

of the roundtrip time by the speed of light. The laser rangefinder 80*g* is further configured to monitor changes in distance X as the body 34 moves relative to the second reference location R2 at the rig floor surface 11. In one embodiment of the present disclosure, the laser rangefinder 80*g* continuously or frequently transmits energy pulses 62 from the first reference location R1 on the instrumented sub 2, bouncing them off the second reference location R2 back to the laser rangefinder.

Referring to FIGS. 5 and 6, the laser rangefinder can be used to monitor positional changes of the instrumented sub 32 over time. As shown in FIG. 5, the instrumented top sub 32 is at a first or elevated position above the rig floor surface 11 and the attached drill string 20 extends from the blow out preventer 13 through the rig floor 11 and into the borehole B in the formation F. The elevated position in FIG. 5 can be where time (mins) is equal to "y" or zero. In FIG. 5, the laser rangefinder can determine the first distance X1 as discussed above. Referring to FIG. 6, the instrumented top sub 32 has been advanced in a downhole direction D toward the rig floor surface 11 as the drill string 20 drills further into the formation F until the instrumented sub 32 reaches a lowered position as illustrated. The laser rangefinder can determine the second distance X2, which is less than the first distance X1. The lowered position in FIG. 6 can be where time (mins) is equal to y+z (e.g. 0+30 minutes). The difference between the first distance X1 and the second distance X2 is the travel distance of the instrumented top sub 32, and drill string 20. The processor is configured to determine one or more parameters based on the first distance X1, second distance X2, and travel time. The travel time is the period of time required for the instrumented sub 32 to move from the elevated position to the lowered position. The processor can then determine a rate of penetration (ROP) of drill bit into the formation F by dividing the travel distance by the travel time. The processor can execute a software program to determine the distance between the rig floor 11 and other components of the drilling system, such as the top drive unit 10.

The instrumented sub 32 also includes a pressure sensor 80*h* and a switch connected the pressure sensor and the power assembly 70. The switch is configured to, upon detection of a decrease in pressure below a predetermined threshold, automatically shut off power supplied by the power assembly 70 such that the instrumented sub 32 conserves power.

The instrumented sub 32 also includes a set of temperature sensors 80*i* that are electrically coupled to the controller 60. The temperature sensors 80*i* can reside in the chamber 58*c* of the base component 36 proximate the controller 60. The controller 60 is configured to, in response to receiving data from the set of temperature sensors 80*i* indicative of temperatures above a predetermined threshold, automatically shut off power supplied by the power assembly. Thus, if the temperature exceeds a threshold, power to the sensors, communication device, etc., is shut off.

In one embodiment, the instrumented sub 32 includes sensors in table 1 below. At least one processor in the surface control system 200 is configured to determine the associated measurement.

TABLE 1

| Measurement | Sensor |
|---|---|
| Top drive height | Laser Rangefinder |
| Drill string rotation speed | Gyrometer/Gyroscope |

TABLE 1-continued

| Measurement | Sensor |
|---|---|
| Drill string hookload | Strain Sensor Assembly |
| Drill string torque | Strain Sensor Assembly |
| Mud flowrate | Flowmeter |
| Mud pressure | Pressure Sensor Assembly |
| Mud temperature | Pressure Sensor Assembly |
| Drill string vibrations | Accelerometer Package or Strain Sensors |
| Drill string torsional vibrations | Accelerometer Package or Strain Sensors |
| Battery life & Voltage | Electrical Circuitry |
| Housing Pressure | Pressure Sensor |
| Housing Temperature | Temperature Sensor |

Turning now to FIG. 4, the monitoring system 30 includes the instrumented top sub 32, the surface communication system 100, a surface control system 200, a downhole communications system 400 (or telemetry system 400) and one or more downhole tools 300.

The surface communication system 100 is configured to permit communications between the instrumented sub 32 and the surface control system 200 located on the rig floor 11. The surface communication system 100 includes the communication device 90 housed in the instrumented sub 32. The communication device 90 can be a radio frequency component, such as a transceiver 92. The communication system 100 may be a wireless system. The surface communication system 100 may include the radio transceiver 92 housed within the instrumented sub 32. The transceiver 92 can be referred to as a "top drive sub radio transceiver." The surface communication system 100 also includes a first radio transceiver 110 (also referred to as "a first routing transceiver") located in proximity to the instrumented sub 32 above the rig floor 11, a second radio transceiver 120 (or "second routing transceiver"), and a third radio transceiver 130 (or a "coordinating transceiver") located in a cabin 12 or other enclosure. The coordinating transceiver 130 is in electronic communication with the surface control system 200 on the rig floor 11. The Zigbee protocol may be used for wireless communications technology. In the Zigbee protocol, the top drive sub radio transceiver 92 communicates with the coordinating transceiver 130 via one or more of the routing transceivers 110 and 120. The surface communication system 100 may be similar to that described in U.S. Pat. No. 8,525,690 (the "690 patent"), assigned to APS Technology. The entire disclosure of the 690 patent is incorporated by reference into this application.

In accordance with another embodiment of the present disclosure, the surface communication system 100 may include another transceiver disposed on the mast 4 or in proximal location on the top drive unit 10. The additional transceiver may be used to provide an additional communications link between the surface control system 200 and the instrumented sub 32. In one example, the additional transceiver operates at higher frequencies compared to the communication device 90, and may be utilized to provide fast transmittal and reception of large volumes of data and large numbers of messages. Yet another, additional, lower frequency transceiver may be utilized when a smaller volume of data or fewer messages are required. In an event, such as communications interference, caused by other local radios, the driller may switch from one transceiver to the other transceiver to ensure a low bit error rate.

Continuing with FIG. 4, the monitoring system 30 includes a surface control system 200 communicatively coupled to a surface communication system 100 and a downhole communication system 400 (also referred to as the telemetry system). The surface control system 200 is configured to receive, process, and store drilling data obtained from surface sensors located in the instrumented sub 32. The surface control system 200 can include one or more computing devices 201 configured to operate and control various aspects of the drilling system 1. As illustrated, the surface control system 200 can be in electronic communication with the transceivers 110, 120, 130 of the surface communication system 100. The transceivers 110, 120, 130 can receive signals transmitted from the instrumented sub 32 as discussed above. The surface control system 200 is also configured to receive, process, and store drilling data obtained from downhole sensors located in the downhole tools 300. The surface control system 200 can be in electronic communication with the receiver 410 of the downhole communication system 400. The receiver 410 can receive signals transmitted from the downhole tool 300.

The surface control system 200 can include one or more computing devices 201 that can host a software programs configured to process, monitor, analyze, and display obtained surface data and/or downhole data. The computing devices 201 are further configured to initiate control operations or instructions to one or more components of the drilling system 1, such as the top drive unit 10, stand handling equipment, etc. It will be understood that the surface control system 200 can include any appropriate computing device, examples of which include a desktop computing device, a server computing device, or a portable computing device, such as a laptop, tablet or smart phone. In an exemplary configuration illustrated in FIG. 4, the surface control system 200, and in particular the surface computing devices 201 includes a processing portion 202, a memory portion 204, an input/output portion 206, and a user interface (UI) portion 208. It is emphasized that the block diagram depiction of the surface control system 200 is exemplary and is not intended to imply a specific implementation and/or configuration. The processing portion 202, memory portion 204, input/output portion 206 and user interface portion 208 can be coupled together to allow communications therebetween. As should be appreciated, any of the above components may be distributed across one or more separate devices and/or locations.

The processing portion 202 may include one or more computer processors configured to execute one or more software programs hosted by the surface control system 200. The processing portion 202 can include a number of different types of processors as needed, such as microprocessors, digital signal processor, coprocessors, networking processors, multi-core processors, and/or front end processor, and the like.

The input/output portion 206 includes input and output channels through which data is received and transmitted. The input/output portion 206 may include a receiver of the surface control system 200, a transmitter (or transceiver) (not to be confused with components of the surface communication system 100 and downhole communication system 400 described below) of the surface control system 200, and/or electronic connectors for wired connection, or a combination thereof. The input/output portion 206 is capable of receiving and/or providing information pertaining to communication with the surface communication system 100, the downhole communication system 400, or other networks, such as a LAN, WAN, or the Internet. As should be appreciated, transmit and receive functionality may also be provided by one or more devices external to the surface control system 200. For instance, the input/output portion 206 can be in electronic communication with the transceiver 110.

The memory portion 204 can be volatile (such as some types of RAM), non-volatile (such as ROM, flash memory, etc.), or a combination thereof, depending upon the exact configuration and type of processor. The surface control system 200 can include additional storage (e.g., removable storage and/or non-removable storage) including, but not limited to, tape, flash memory, smart cards, CD-ROM, digital versatile disks (DVD) or other optical storage, magnetic cassettes, magnetic tape, magnetic disk storage or other magnetic storage devices, universal serial bus (USB) compatible memory, or any other medium which can be used to store information and which can be accessed by the surface control system 200.

The surface control system 200 includes a user interface portion 208. The user interface portion 208 can include an input device and/or display (input device and display not shown) that allows a user to communicate with the surface control system 200. The user interface 208 can include input features that provide the ability to control the surface control system 200 and thus components of the drilling system 1, via, for example, buttons, soft keys, a mouse, voice actuated controls, a touch screen, movement of the surface control system 200, visual cues (e.g., moving a hand in front of a camera on the surface control system 200), or the like. The user interface 208 can provide outputs, including visual information, such as the visual indication of the plurality of operating ranges for one or more parameters via the display (not shown). Other outputs can include audio information (e.g., via speaker), mechanically (e.g., via a vibrating mechanism), or a combination thereof. In various configurations, the user interface 208 can include a display, a touch screen, a keyboard, a mouse, an accelerometer, a motion detector, a speaker, a microphone, a camera, or any combination thereof. The user interface 208 can further include any suitable device for inputting biometric information, such as, for example, fingerprint information, retinal information, voice information, and/or facial characteristic information, for instance, so as to require specific biometric information for access to the surface control system 200.

An exemplary architecture can include one or more computing devices of the surface control system 200, each of which can be in electronic communication with a database (not shown), the surface communication system 100, and the downhole communications systems 400 via a communications network. The database can be separate from the surface control system 200 or could also be a component of the memory portion 204 of the surface control system 200. It should be appreciated that numerous suitable alternative communication architectures are envisioned. The surface control system 200 may be operated in whole or in part by, for example, a rig operator at the drill site, a drill site owner, oil services drilling company, and/or any manufacturer or supplier of drilling system components, or other service provider. As should be appreciated, each of the parties set forth above and/or other relevant parties may operate any number of respective computing device and may communicate internally and externally using any number of networks including, for example, wide area networks (WAN's) such as the Internet or local area networks (LAN's).

The surface control system 200 can host one or more software programs that can initiate desired decoding or signal processing, and perform various methods for monitoring and analyzing the drilling data obtained during the drilling operation. In use, the user interface 208 of the surface control system 200 runs on a display device, such as a console and is the interface between the drilling operator (and other end users) and the instrumented sub 32. The driller may input a range of commands via the user interface 208 regarding operation of the instrumented sub 32. The operator may also input data for initializing depth tracking, well name, etc. During a drilling operation, the sensors 80 obtain the data and that data is transmitted to the surface control system 200 via the surface communication system 100. The computer processor 202 is configured to execute software program that processes data obtained by the sensors 80, parses the data, timestamps that data, and records the data in job files in the computer memory 204. The user interface 208 can cause the obtained data to be displayed on the display device. For example, the obtained data can be arranged into current and historical data logs (time or depth-based logs) and displayed on a display device. Other software programs can process and analyze the obtained data and create informative meta-data, such as WOB derived from hookload. The stored data and related data files are available for export via standard wired or wireless connections with other components of the drilling system, such as the electronic data recorder. The surface control system 200 also enables for example, WITS data transfer, serial input of MWD downhole data, etc.

Continuing with FIG. 4, the downhole communications system 400 is configured to transmit downhole data to the surface control system 200. The downhole communications system 400 can include at least one surface receiver 410 and a telemetry tool 420. The telemetry tool 420 can include a receiver 422, a power source 424, a controller 426 and a transmission device 428 configured to transmit a signal to the surface receiver 410. The signal can include drilling data encoded therein concerning the data obtained via the downhole via downhole sensors. The downhole communications system 400 can be a mud-pulse telemetry system as illustrated. It should be appreciated that other telemetry systems can be used to transmit information from the tools 300 to the surface control system 200. For example, the downhole communications system can be an electromagnetic telemetry system, acoustic telemetry system, or a wired pipe system.

The mud-pulse telemetry system comprises the controller 426, a transmission device 428 in the form of a rotary pulser, a receiver 410 in the form of a pressure pulsation sensor, and a flow switch or switching device. The pulser 428 is used to transmit signals through the drilling mud to the surface receiver 410. The switching device senses whether drilling mud is being pumped through the drill string 20. The switching device is communicatively coupled to the controller 426. The controller 426 can store data when drilling mud is not being pumped, as indicated by the output of the switching device. A suitable switching device can be obtained from APS Technology as the FlowStat™ Electronically Activated Flow Switch. The controller 60 can encode the information it receives from the controller of an MWD tool or direction tool as a sequence of pressure pulses. The controller 426, in response to inputs received, can cause the pulser 428 to generate the sequence of pulses in the drilling mud. Pressure pulsation sensor can be a strain-gage pressure transducer (not shown) located at the surface S that can sense the pressure pulses in the column of drilling mud, and can generate an electrical output representative of the pulses received from the downhole pulser. The electrical output of the transducer at the surface can be transmitted to the surface control system 200, which can decode and analyze the data originally encoded in the mud pulses.

A processor can increase the signal-to-noise ratio of mud pulse signals transmitted by a mud pulser located downhole based at least partially on a measurement of the pressure of the fluid obtained by the pressure sensor assembly 80*b*. The monitoring system 30 may include an input pressure sensor assembly positioned on an input line of the mud system between a pump 16 and the instrumented sub 32. The input pressure sensor assembly can measure pressure of the fluid at the input line. The processor is configured to increase the signal-to-noise ratio of mud pulse signals transmitted by a mud pulser located downhole based at least partially on a measurement of the pressure of the fluid obtained by the pressure sensor assemblies on the instrumented sub and the input line.

The monitoring system 30 is configured so that the driller can select and/or create operating instructions for the instrumented top sub 32 based on current rig activity, such as drilling, circulating, tripping, etc. The set of operating instructions may include a selection of sensor measurement, sampling frequency, data processing protocols, power saving instructions, data types to return the computing devices, such as value of a parameter, units, etc. The surface control system 200 communicates the set of operating instructions to the communication device 90 of the instrumented sub 32. The communication device 90 conveys the operating instructions to the controller 60. The controller 60 (or processor) executes the set of operating instructions to obtain the data indicative of the desired drilling parameters. For example, the set of operating instructions may include protocols for the supply and subsequent removal power to certain sensors that measure particular drilling parameters, such as hookload. The instructions, when executed, can remove power from the sensors after the intended data acquisition is complete. Other protocols may include the time and duration that each sensors will operate to simultaneously acquire their respective measurements.

The set of operating instructions may also include, for individual sensors, sampling frequencies, processing means, and values for the obtained data to return to the surface control system 200. The sensors 80 can be operated selectively according to the set of operating instructions based one or more operating modes. The operating modes include, but or not limited to: A) drilling mode that includes drilling, washing and reaming activities; B) a burst mode that emphasizes a longer duration for vibration measurements; C) a short trip mode that corresponds to removal of a portion of drill pipe; D) a pulling mode that corresponds to removal of the drill string from the borehole; E) a fluid circulation mode where drill string is stationary and drilling fluid is flowing through for a period of time; F) a casing running mode that corresponds to installation of casing pipe into the borehole and may not require operation of any sensor (Table 2, "F.Run Csg"); and G) rig repair mode where activities do not require operation of any sensor (Table 2, "G.Rig Repair"). Other mode types can be devised based on particular sub operations of drilling. Table 2 is a tasking table that includes the circumstances in which power is supplied (or not supplied) to the sensors 80 for the drilling operating modes described above. For example, during a drilling mode A) that includes drilling, washing and reaming activities, all of the sensors are powered and making measurements (Table 2, "A. Drilling/Wash&Ream") Table 3 is tasking table that summarizes sensor cycle times for each sensor, for each drilling operating mode.

TABLE 2

| Tasking Table for Power Supply | | | | | | | |
|---|---|---|---|---|---|---|---|
| Sensor> | Height | RPM | Hkld | Trq/Bnd | Accels | P/T | Flow |
| Operating Mode | | | | | | | |
| A. Drilling/Wash * Ream | Y | Y | Y | Y | Y | Y | Y |
| B. Drilling/Burst Mode | Y | Y | Y | Y | Y | Y | Y |
| C. Drilling/Decode | Y | Y | Y | Y | Y | Y | Y |
| D. Short Trip | Y | y | Y | Y | Y | Y | Y |
| E. POOH/TIH | Y | y | Y | Y | N | N | N |
| F. Circ/Kick | y | y | y | N | N | Y | Y |
| G. Run Csg | N | N | N | N | N | N | N |
| H. Rig Repair | N | N | N | N | N | N | N |
| Legend | Y: | powered, on ≥ off per unit time | | | | | |
| | y: | powered, on ≤ off per unit time | | | | | |
| | N: | not powered | | | | | |

TABLE 3

| Tasking Table with Details of Sensor Duty Cycle Times | | | | | | | |
|---|---|---|---|---|---|---|---|
| Sensor> | Height | RPM | Hkld | Trq/Bnd | Accels | P/T | Flow |
| Activity: | | | | | | | |
| A. Drilling/Wash * Ream | 1.00 | 0.50 | 0.50 | 0.50 | 0.50 | 0.50 | 1.0 |
| B. Drilling/Burst Mode | 1.00 | 0.50 | 0.50 | 0.50 | 1.00 | 0.50 | 1.0 |
| C. Drilling/Decode | 1.00 | 0.50 | 0.50 | 0.50 | 0.50 | 1.00 | 1.0 |
| D. Short Trip | 1.00 | 0.25 | 0.50 | 0.50 | 0.50 | 0.50 | 1.0 |
| E. POOH/TIH | 1.00 | 0.10 | 0.50 | 0.50 | N | N | N |
| F. Circ/Kick | 0.5 | 0.10 | 0.3 | N | N | 0.50 | 1.0 |
| G. Run Csg | N | N | N | N | N | N | N |
| H. Rig Repair | N | N | N | N | N | N | N |
| Legend | x.xx | sensor on time per second | | | | | |
| | y: | | | | | | |
| | N: | not powered | | | | | |

Furthermore, the operator can also select or create instructions regarding when and how often obtained data streams are transmitted to the surface control system 200. The controller 60 causes the communication device 90 to transmit the obtained data streams wirelessly to the transceivers 110, 120, 130 and to the surface control system 200 at predefined intervals, such as every 1 second, 10 second, 1 minute, 10 minutes, etc. The data streams can be processed, analyzed, stored in the computer memory (e.g. as time stamped records), and displayed by the user interface 208 on the display device.

Figure 7:
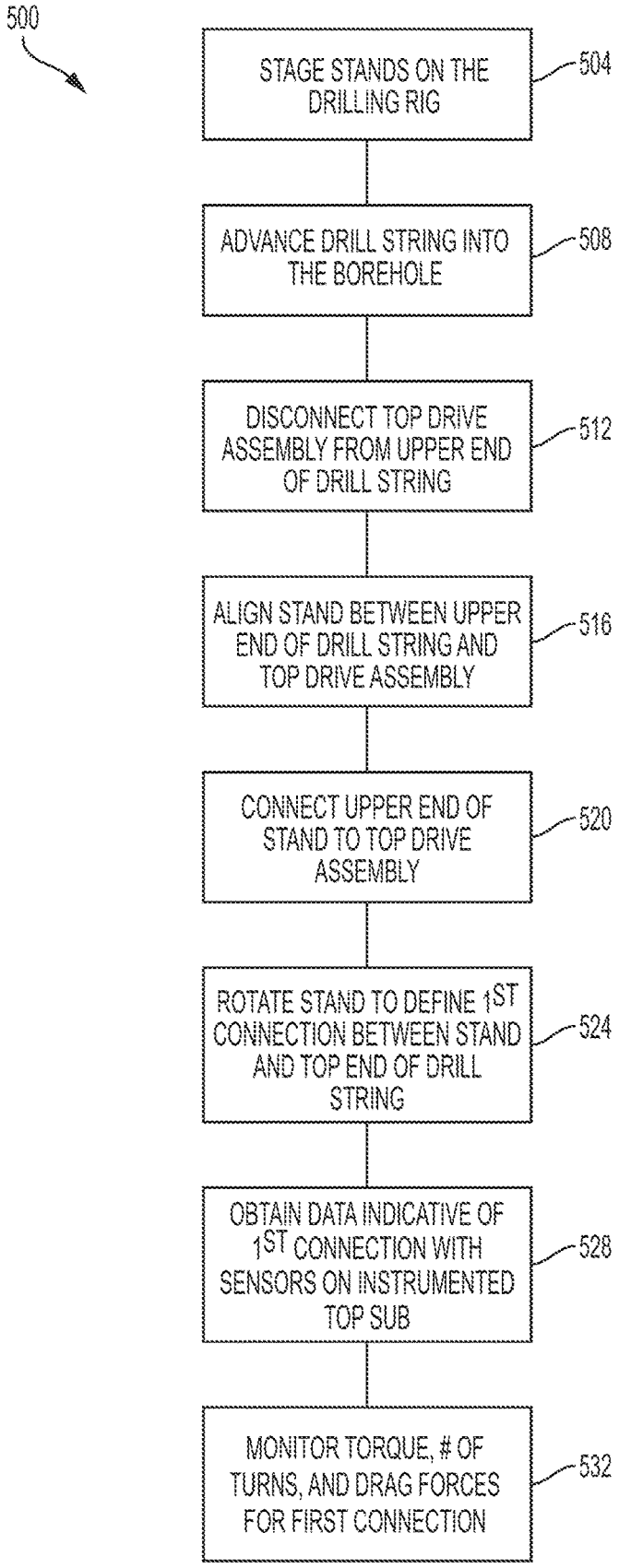
FIG. 7 is a process flow diagram for a method of monitoring make-up of a drill string, according to an embodiment of the present disclosure.
Figure 8A:
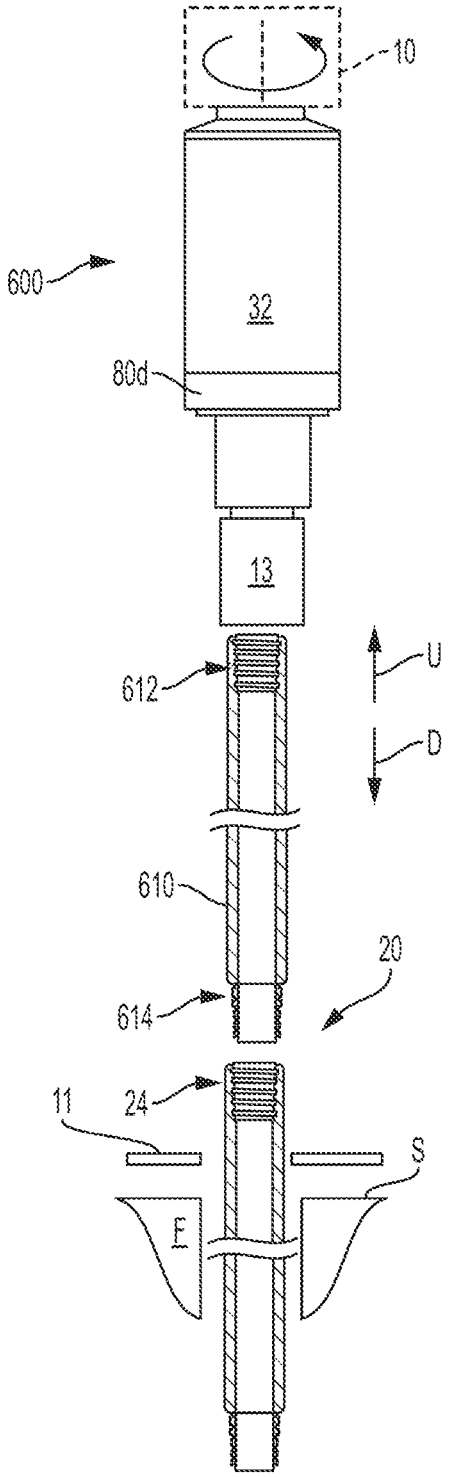
FIGS. 8A-8D are schematic side views of the instrumented sub monitoring make-up of the drill string according to the process illustrated in FIG. 7.
Figure 8B:
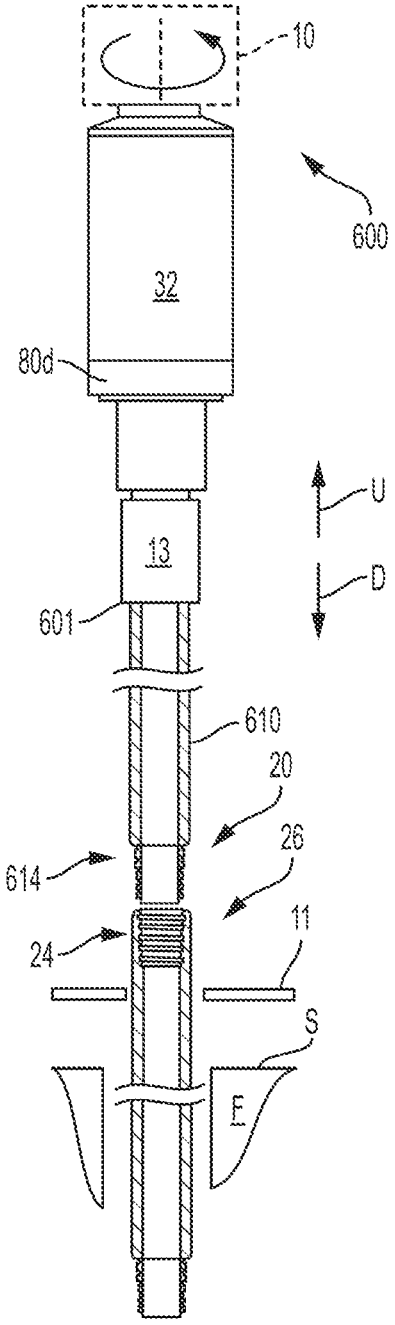
Figure 8C:
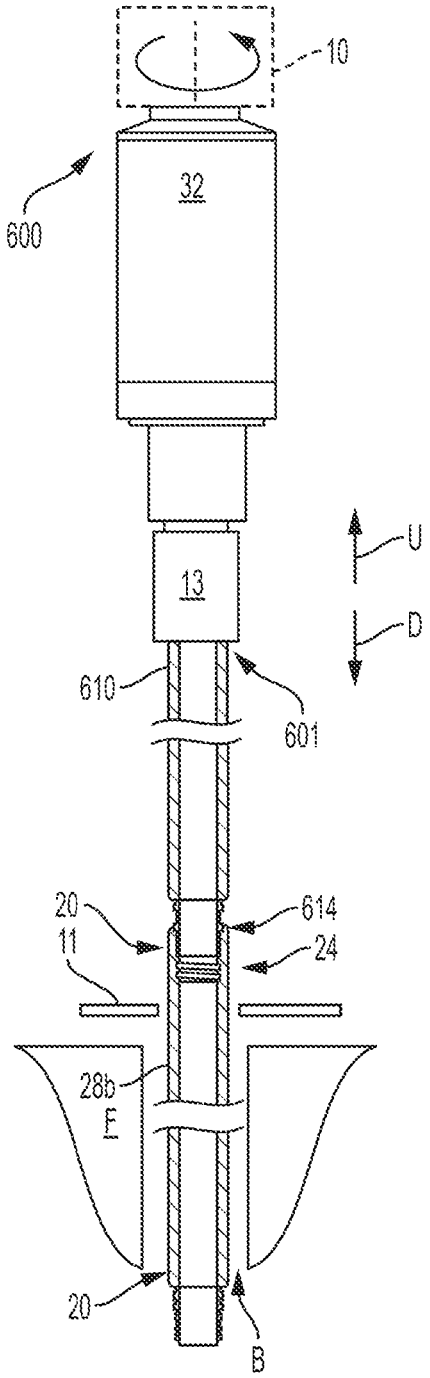
Figure 8D:
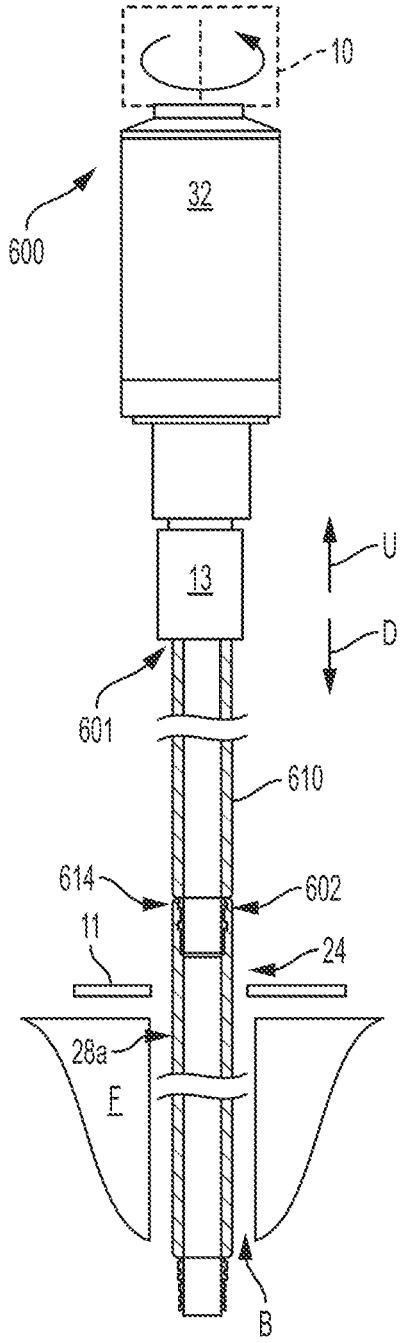

The instrumented top sub 32 enables a number methods related to drilling operations. Referring to FIGS. 7-8D, an embodiment of the present disclosure includes a method 500 for monitoring a make-up operation at a drilling rig using a top drive unit 10. As shown in FIGS. 8A-8B, a top drive assembly 600 includes a top drive unit 10 (shown in dashed lines), the instrumented top sub 32 coupled to the topdrive unit 10, a blowout preventer 13 coupled to the instrumented top sub 32. The top drive assembly 600 can be connected directly to an end of a stand or drill string 20 and rotates the drill string 20 to drill the borehole B.

Referring to FIGS. 7, 8A and 8B, the method 500 includes a step 504 of staging a plurality of stands on the mast (or catwalk) for manipulation by a joint handling equipment. As described above, the stands can include two tubulars 28, three tubulars 28, or four tubulars 28. In step 508, the top drive assembly 600 advances the drill string into the borehole B unit 10 until the upper end 26 of the drill string 20 is positioned above the rig floor 11, as illustrated in FIG. 8A. The joint equipment grabs the upper end 26 of the drill string 20 and secures it place against rotation and from falling into the borehole B. In step 512, the top drive assembly is disconnected from the upper end 26 of the drill string 20.

In step 516, a new stand 610 is positioned between the top end 26 of the drill string 20 and the lower end (not numbered) of the top drive assembly 600. The joint handling equipment aligns a top threaded connector 612 of the stand 610 with a threaded connector of the top drive assembly 600. In step 520, the top threaded connector 612 is threadably coupled to the threaded connector of the top drive assembly 600. In step 524, top drive assembly 600 rotates the stand 610 to threadably connect the stand 610 to the top end of the drill string 20. It should be appreciated that the top end of the drill string is the top end of the previously added stand.

In step 528, while the stand 610 is being threadably coupled to the top drive assembly 600, the plurality of sensors obtain data that is indicative of the threaded connection. Data indicative of the threaded connection may include A) a number turns of the first stand until full connection, B) torque applied to the instrumented sub 32, C) a drag forces along the drill string. As discussed above, the instrumented top sub 32 includes a strain sensor assembly 80*a* that can measure axial forces, torsion forces, compression forces. The axial, torsion, and bending forces can be used to determine torque applied the instrument sub and thus the stand. The gyrometer 80*d* is configured to obtain data that is indicative of a rotational speed of the instrumented sub 32 of the instrumented sub. The rotational speed and measure time clock can be used to determine the number of turns the stand was subjected to before full or specified torque is reached. In an alternative embodiment, a gyroscope can be used to determine rotation speed and number of turns of the stands.

In step 532, the instrumented sub 32 and surface control system 200 can monitor connection parameters for the first thread connection 600 between the first stand 610 and the end of the drill string 20. In step 532, the threaded connection between the bottom end 614 of the first stand 610 and the top end of the drill string 20 is monitored until the desire torque is obtained and "connection" is made, as illustrated in FIG. 8D. After the stand 610 the desired threaded connection is achieved, the top drive assembly rotates the connected first stand 610 and drill string 20 so as to advance a drill bit further into an earthen formation until a top end 612 of the first stand 610 is positioned at a rig floor 11. The steps 504 to the 532 are repeated for each new stand.

Embodiments of the present disclosure include several methods for monitoring and control of different aspects of a drilling operation. In accordance with an embodiment, one method includes monitoring a drilling system and utilizing a predicative model. The method includes drilling a borehole into an earthen formation with a drill bit. During drilling, surface data is obtained via a plurality of surface sensors carried by an instrumented sub 32. In one example, the method of obtaining surface data also include obtaining vibration data, such as a mode shape, an amplitude and a frequency of vibration. Furthermore, the obtaining step may also include obtaining surface data that is indicative axial vibration, torsional vibration, and lateral vibration. Other surface data includes at least one of: 1) a change in a distance X over a period of time; 2) a measurement of weight on bit; 3) a measurement of torque applied to the drill string; and 4) a rotational speed of the drill string.

The method includes obtaining downhole data with a plurality of downhole sensors disposed along the drill string and positioned near a drill bit. The downhole data may include: a) a measurement of downhole weight-on-bit; b) a downhole measurement of torque-on-bit; c) a rotational speed of the drill bit; d) axial vibration of a bottom hole assembly; e) a torsional vibration of a bottom hole assembly; and f) a lateral vibration of a bottom hole assembly.

Then, the method also includes adjusting a drill string component model based on the obtained surface data and the obtained downhole data. The drill string component model is configured to predict one or more operating parameters of the drilling system. The surface data obtained with the surface sensors can be correlated with the downhole data obtained with the downhole sensors. The drill string model can be further developed based on the correlated drilling data.

Another embodiment of the present disclosure is method for monitoring a drilling system. Here, the method includes drilling a borehole into an earthen formation, and obtaining surface data with the plurality of surface sensors carried by an instrumented sub 32. The surface data is then transmitted to a computer processor. The computer processor determines a torque applied to the instrumented sub based on the surface data. In one example, the method includes determining a variance between the torque applied to the instrumented sub and a predicted torque applied to the instrumented sub. The predicted torque is based on a drilling model that includes drill string data, formation characteristics, drilling fluid data, and estimated coefficients of the friction for components of the drill string and a borehole wall. The method may also include the step of predicting drag forces along the drill string based on the drilling model.

Yet another embodiment of the present disclosure a method for monitoring a top drive unit 10 of a drilling system. Such method includes obtaining surface data with the plurality of sensors carried by the instrumented sub. However, in accordance with the present embodiment, the surface data is indicative of a bending moment and a bending angle applied the instrumented sub. Based at least on the bending moment and the bending angle applied to the instrumented sub, the method permits monitoring one or more operational parameters of the top drive unit during a drilling operation. One of the operational parameters is an alignment between the top drive unit and a centerline of a hole in the rig floor. Accordingly, the method includes determining an offset between a central axis of the top drive unit and the centerline of the hole in the rig floor. An alert can be initiated if the offset falls outside of the predetermined threshold. A second alert different from the first alert can be initiated if the offset is within the predetermined threshold. The method also includes a step of initiating a third alert different from the first and second alert if there is substantially no offset such that the top drive unit and the centerline of the hole are substantially aligned.

Another embodiment of the present disclosure a method for controlling a drilling system. The method includes drilling a borehole into the earthen formation with a drill bit at an end of the drill string and obtaining surface data with the plurality of surface sensors of the instrumented sub 32. The method can include obtaining downhole data with a plurality of downhole sensors positioned along a portion of the drill string located inside the borehole. Then, the surface data and the downhole data are analyzed with a drilling model. The drilling model includes one or more characteristics of the earthen formation, drilling fluid information, and drill bit data. The drilling model my also include offset well data.

In response to the analyzing step, the method can adjust at least one of A) a weight-on-bit, B) a flow rate of the fluid, and C) a rotational speed of the drill string to control a rate-of-penetration (ROP) of the drill bit. The ROP can be adjusted based on at least one of an inclination, an azimuth, a tool face angle of the drill bit, and a parameter for the formation in proximity to the drill bit. Furthermore, ROP can be adjusted based on a model of the bottomhole assembly. The method also includes controlling operation of a brake on a rig line based on a measured hook load. The method also includes controlling a differential pressure across a downhole motor configured to rotate the drill bit.

In accordance with present embodiment, it should be appreciated that the surface data includes at least one of: 1) a change in a distance over a period of time, wherein the distance extends from a first reference location on the instrumented top sub above a rig floor to a second reference location on the rig floor that is aligned with the first reference location; 2) data indicative of weight-on-bit (WOB), 3) a data indicative of torque applied to the drill string, and 4) a rotational speed of the drill string. The downhole data includes at least one parameter indicative of the formation in proximity to the drill bit, a measurement of downhole weight-on-bit, a measurement of torque-on-bit, and a rotational speed of the drill bit.

Another embodiment of the present disclosure is method for controlling the trajectory of drilling a borehole based on measured depth data of a drill bit. The control of trajectory is based on a measured depth of the bit using the instrumented top sub. The method initiates by drilling a borehole into the earthen formation toward a predetermined target location. Next, a determination is made regarding a change in a depth of the drill bit into the earthen formation along the borehole over a period of time. As used herein, the depth extends from a surface of the earthen formation along the borehole to a terminal portion of the drill bit. The method also includes transmitting the data indicative the change in depth over the period of time to the surface using one of a mud pulse telemetry system, an acoustic telemetry system, an electromagnetic telemetry system, or a wired pipe telemetry system. Then, depth data over time is transmitted to a directional drilling tool. In response to receiving the change in the depth over the period of time, the direction tool can adjust the trajectory of the drill bit with so as to minimize fluctuations in a path of the borehole toward the predetermined target location. The change in depth over the period of time can be transmitted at predetermined time intervals to the directional tool. The change in depth over the period of time can be referred to as a depth change rate.

The direction tool can adjust the direction of drilling by obtaining data indicative of an inclination and azimuth of the drill bit. The method further includes determining if the depth change rate, the obtained inclination data, and the obtained azimuth data are within their respective predetermined thresholds. If one or more of these data values are outside of their predetermined thresholds, the trajectory of the drill bit is adjusted to toward the correct source. Furthermore, the adjusting step occurs automatically in response to receiving data indicative of depth of the drill bit.

One way to measure depth is based a distance an instrumented top sub travels toward a rig floor surface as the drill string is advanced into the earthen formation. As described above, the distance X extends from a first reference location on the instrumented sub 32 and a second reference location at the rig floor 11 and aligned with the first reference location. The methods related to depth measurement including moving the top drive unit between A) an elevated position where the instrumented sub 32 *s* positioned above the rig floor surface the first distance so as to receive a top end of a drill string tubular, and B) a lowered position where the instrumented sub is positioned a second distance smaller than the first distance. The depth of the drill bit into the earthen formation is based on a) a difference between the first distance and the second distance, and b) the number of drill string tubulars added to the drill string. The change in depth over the period of time can be used to accurately determine rate-of-penetration (ROP) of the drill bit.

In one example, the method includes transmitting a target ROP to the directional drilling tool before the drill bit drills a predetermined short section of the borehole. Then, the method includes controlling the actual ROP while the drill bit drills the short section of the borehole, and determining a depth of the drill bit while drilling the short section of the borehole by integrating the actual ROP over the period of time.

In another example, the method includes the step of determining a rate-of-penetration for the drill bit is based on A) surface data with a plurality of surface sensors carried by an instrumented sub, B) downhole data obtained with a plurality of downhole sensors carried by the drill string at a location proximate the directional tool, C) a model of the drill string, and D) actual operating values for weight-on-bit, a fluid flow rate, and a rotational speed of the drill string.

Another embodiment of the present disclosure relates to monitoring a downhole motor, such as a mud motor. In accordance the such an embodiment, the method obtaining surface data with a plurality of surface sensors carried by the instrumented sub 32. In accordance with the present embodiment, the surface data is indicative of a pressure and a flow rate of a fluid circulating through the instrumented sub 32. The drilling fluid data is then sent to surface computing device. The method includes determining, via the at least one computer processor, an efficiency of the downhole motor. The efficiency is based on the pressure of the fluid, the flow rate of the fluid, and an operational model of the downhole motor. In addition, the efficiency of the downhole motor is monitored over a period of time.

The method also includes obtaining downhole data with a plurality of downhole sensors positioned along a bottomhole assembly. In accordance with present embodiment, the downhole data is indicative of a pressure of the fluid inside an internal passage of the bottomhole assembly, and a pressure of the fluid in an annular passage disposed between the drill string and the formation. The obtained downhole data is sent to the surface computing device. Then, the computing device determine a second efficiency of the downhole motor based on a downhole data. Specifically, the second efficiency is based on a) the pressure of the fluid inside the internal passage of the bottomhole assembly, b) the pressure of the fluid in the annular passage, and c) the operational model of the downhole motor. The second efficiency of the downhole motor is monitored over a period of time. Furthermore, the method then includes obtaining vibration data that is indicative of actual vibration of the instrumented sub 32. A speed of a rotor in the downhole motor can be determined based on the vibration data. The method can include monitoring performance of the downhole motor based on the speed of the rotor, the pressure of the fluid, and the flow rate of the fluid.

Another embodiment of the present disclosure relates to monitoring certain types of drilling operations, such as presence of an influx, etc. The method includes drilling a borehole into the earthen formation and circulating a drilling fluid trough the drill string and the drill bit and out of the borehole. During the circulating step, surface data is obtained by the surface sensors in the instrumented sub 32. In accordance with present embodiment, the surface data is indicative of A) a weight on bit, B) a torque applied to a drill string, C) a rate of penetration, D) a flow rate of the drilling fluid, and E) a pressure of the drilling fluid. The obtained surface data is then displayed on a display unit.

The method may also determine, or facilitate an identification, if a drilling break in the drilling operation has occurred. A drilling break is a sudden large variance in a measured drilling parameter. For instance, a drilling break may be a sudden large increase in the rate of penetration, usually accompanied with a sudden large change in hook-load/weight on bit and drill string torsion. In response to the determining step, if a drilling break has occurred, the computing device can causes an alert to be displayed on the display unit of the computing device. In this example, the alert includes a warning of a possible influx. An influx as used herein is an undesirable, uncontrolled, entry of formation fluids into the borehole and is also termed a kick. Kicks are often forewarned by a drilling break. In presence of a possible break, the method continues by verifying if there has been an influx into the borehole. If there has been an influx, circulation of the fluid into and out of the borehole is stopped. Next, the annular blowout preventers are closed. After fluid circulation has stopped, a pressure of the fluid in the instrumented sub 32 is measured and displayed on a display unit. Here, the method includes determining a density of a kill fluid based on the pressure in the instrumented sub. Next, the annular blowout preventers are opened and the influx is circulated out of the borehole annulus, via the prescribed slow circulation, constant pressure manner.

Another embodiment of the present disclosure is a method for monitoring a kill operation. The method includes a step of obtaining a first data set with the surface sensors. The first date set concerns a first fluid passing through the instrumented sub. The first data set, however, is indicative of a pressure of the first fluid, a temperature of the first fluid, a flow rate of the first fluid, a density of the first fluid. A computing device can cause the display of the first data set. Next, the method includes causing a second fluid to flow through the instrumented sub that is different from the first fluid so as to displace the first fluid out of the borehole. Using the surface sensors in the instrumented top sub, a second data set concerning the second fluid is obtained. The second data set is indicative of one or more parameters of the second fluid. The method can include transmitting to the computer processor the first data set concerning the first fluid and the second data set concerning the second fluid. The transmitting steps continue until the kill operation is complete.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

We claim:

1. An instrumented sub configured to be coupled to a drill string at or above a rig floor surface of a drilling rig, the instrumented sub comprising:

a body including an outer wall, an inner wall spaced from the outer wall in a linear direction, a top end, a bottom end spaced from the top end in an axial direction, a sealed chamber that extends between the outer wall and the inner wall, and an internal passage that extends from the top end to the bottom end along the axial direction, the internal passage configured to receive therethrough a drilling fluid when the body is coupled to the drilling rig;

a sensor carried by the body, the sensor configured to obtain data indicative of a drilling parameter;

a pocket recessed into the body, the pocket configured to contain one or more of a plurality of sensors;

a controller located in the sealed chamber and electrically connected to the plurality of sensors, the controller configured to control operation of the plurality of sensors; and a communication device electrically connected to the controller, the communication device configured to transmit data obtained by the sensors to a computing device on the drilling rig.

2. The instrumented sub of claim 1, wherein the body includes a base pipe and a housing coupled to the base pipe and that surrounds the base pipe, wherein the internal passage extends through the base pipe and the housing holds the sensor.

3. The instrumented sub of claim 1, wherein the top end of the body defines a threaded connection end for threadably connecting to a rotating member of a top drive unit, wherein the bottom end of the body defines a threaded connection end for threadably connecting to either: a) a top of a drill string tubular, b) a top of a blowout preventer, or c) a saver sub.

4. The instrumented sub of claim 1, further comprising a power assembly configured to supply power to the sensor, the controller, and the communication device.

5. The instrumented sub of claim 4, wherein the power assembly includes a first power source configured to supply the power and a second power source configured to recharge the first power source.

6. The instrumented sub of claim 5, wherein the first power source is a battery pack, and the second power source is at least one thermal electric power device.

7. The instrumented sub of claim 6, wherein the thermal electric power device is a thermal electric generator or a thermal electric cooler.

8. The instrumented sub of claim 1, wherein the sensor includes one of the following sensors: a flow meter, a distance sensor, a pressure sensor assembly, a strain gage, a gyrometer, a magnetometer, a temperature sensor, and an accelerometer.

9. The instrumented sub of claim 1, wherein the sensor is a flow meter positioned to face the internal passage, the flow meter configured to obtain data that is indicative of a flow rate of the fluid through the internal passage.

10. The instrumented sub of claim 9, wherein the flow meter is configured to obtain data that is indicative of a density of the fluid.

11. The instrumented sub of claim 9, wherein the flow meter is an ultrasonic flow meter.

12. The instrumented sub of claim 9, wherein the flow meter is a differential pressure flow meter.

13. The instrumented sub of claim 1, wherein the sensor is a distance sensor configured to measure a distance from a first reference location on the body to a second reference location that is spaced away from and aligned with the first reference location along the axial direction.

14. The instrumented sub of claim 13, wherein the second reference location is a surface of the rig floor and the distance is substantially parallel to the axial direction.

15. The instrumented sub of claim 13, wherein the distance sensor is configured to measure the distance as the body moves relative to the rig floor surface.

16. The instrumented sub of claim 13, wherein the distance sensor is a laser rangefinder.

17. The instrumented sub of claim 16, wherein the body includes a housing having a chamber, and a port that extends from the chamber to the bottom end, and the laser rangefinder is held in the chamber such that a laser emitted from the laser rangefinder passes through the port to the second reference location when the instrumented sub is disposed above the rig floor surface.

18. The instrumented sub of claim 1, wherein the sensor is a pressure sensor assembly that is at least partially exposed to the internal passage, wherein the pressure sensor is configured to measure a pressure of the fluid as it passes through the body of the sub.

19. The instrumented sub of claim 18, wherein the pressure sensor assembly includes a pressure transducer and a temperature sensor.

20. The instrumented sub of claim 1, wherein the sensor is a set of accelerometers, the set of accelerometers configured to obtain data indicative of a mode shape, an amplitude and a frequency of vibration.

21. The instrumented sub of claim 20, wherein the vibration is at least one of a) an axial vibration of the instrumented sub, b) a torsional vibration of the instrumented sub, c) a lateral vibration of the instrumented sub, d) a radial vibration of the instrumented sub, and e) a tangential vibration of the instrumented sub.

22. The instrumented sub of claim 1, wherein the sensor is a gyrometer, the gyrometer configured to obtain data that is indicative of a rotational speed of the instrumented sub when the instrumented sub is coupled to a top drive unit and caused to rotate.

23. The instrumented sub of claim 1, wherein the sensor is a strain sensor assembly arranged to obtain data indicative of torque applied to the instrumented sub.

24. The instrumented sub of claim 23, wherein the strain sensor assembly is at least one bridge of strain gauges arranged to obtain data indicative of axial forces.

25. The instrumented sub of claim 24, wherein the data indicative of axial forces includes a measure of hookload.

26. The instrumented sub of claim 24, wherein the at least one bridge of strain gauges is a first bridge of strain gauges and a second bridge of strain gauges disposed 180 degrees opposite the first bridge of strain gauges.

27. The instrumented sub of claim 24, wherein the at least one bridge of strain gauges is a first bridge of strain gauges, a second bridge of strain gauges, and a third bridge of strain gauges, wherein the first, second, and third bridge of strain gauges are disposed at 120 degree intervals around a central axis of the instrumented sub.

28. An instrumented sub configured to be coupled to a drill string at or above a rig floor surface of a drilling rig, the instrumented sub comprising:

a body including:

a top end, a bottom end spaced from the top end in an axial direction, a housing having a chamber, and a port that extends from the chamber to the bottom end, and an internal passage that extends from the top end to the bottom end along the axial direction, the internal passage configured to receive therethrough a drilling fluid when the body is coupled to the drilling rig;

a plurality of sensors carried by the body, each sensor configured to obtain data indicative of a drilling parameter;

a controller electrically connected to the plurality of sensors, the controller configured to control operation of the plurality of sensors; and a communication device electrically connected to the controller, the communication device configured to transmit data obtained by the sensors to a computing device on the drilling rig;

wherein one of the plurality of sensors is a laser rangefinder configured to measure a distance from a first reference location on the body to a second reference location that is spaced away from and aligned with the first reference location along the axial direction, the laser rangefinder being held in the chamber such that a laser emitted from the laser rangefinder passes through the port to the second reference location when the instrumented sub is disposed above the rig floor surface.

29. The instrumented sub of claim 28, wherein the body includes a base pipe and a housing coupled to the base pipe and that surrounds the base pipe, wherein the internal passage extends through the base pipe and the housing holds one or more of the plurality of sensors.

30. The instrumented sub of claim 28, wherein the top end of the body defines a threaded connection end for threadably connecting to a rotating member of a top drive unit, wherein the bottom end of the body defines a threaded connection end for threadably connecting to either: a) a top of a drill string tubular, b) a top of a blowout preventer, or c) a saver sub.

31. The instrumented sub of claim 28, further comprising a power assembly configured to supply power to the sensors, the controller, and the communication device.

32. The instrumented sub of claim 28, wherein the plurality of sensors includes at least two of the same or different sensors of any of the following sensors: a flow meter, a distance sensor, a pressure sensor assembly, a strain gage, a gyrometer, a magnetometer, a temperature sensor, and an accelerometer.

33. An instrumented sub configured to be coupled to a drill string at or above a rig floor surface of a drilling rig, the instrumented sub comprising:

a body including a top end, a bottom end spaced from the top end in an axial direction, a sealed chamber, and an internal passage that extends from the top end to the bottom end along the axial direction, the internal passage configured to receive therethrough a drilling fluid when the body is coupled to the drilling rig;

a laser rangefinder configured to measure a distance from a first reference location on the body to a second reference location that is spaced away from and aligned with the first reference location along the axial direction, the laser rangefinder being disposed in the sealed chamber such that a laser emitted from the laser rangefinder via a port disposed in the sealed chamber extends to the second reference location when the instrumented sub is disposed above the rig floor surface;

a controller electrically connected to the laser rangefinder and being further configured to control operation of the laser rangefinder; and a communication device electrically connected to the controller, the communication device configured to transmit data obtained by the laser rangefinder to a computing device on the drilling rig.

34. The instrumented sub of claim 33, wherein the body includes a base pipe and a housing coupled to the base pipe and that surrounds the base pipe, wherein the internal passage extends through the base pipe and the housing holds one or more of a plurality of sensors.

35. The instrumented sub of claim 33, wherein the top end of the body defines a threaded connection end for threadably connecting to a rotating member of a top drive unit, wherein the bottom end of the body defines a threaded connection end for threadably connecting to either: a) a top of a drill string tubular, b) a top of a blowout preventer, or c) a saver sub.

36. The instrumented sub of claim 33, further comprising a power assembly configured to supply power to the controller, and the communication device.

37. The instrumented sub of claim 36, wherein the power assembly includes a first power source configured to supply the power and a second power source configured to recharge the first power source.

38. The instrumented sub of claim 37, wherein the first power source is a battery pack, and the second power source is at least one thermal electric power device.

39. The instrumented sub of claim 38, wherein the thermal electric power device is a thermal electric generator or a thermal electric cooler.

40. The instrumented sub of claim 33, further comprising a plurality of sensors carried by the body, each sensor configured to obtain data indicative of a drilling parameter; wherein the plurality of sensors includes at least two of the same or different sensors of any of the following sensors: a flow meter, a distance sensor, a pressure sensor assembly, a strain gage, a gyrometer, a magnetometer, a temperature sensor, and an accelerometer.

* * * * *